US008106730B2

(12) United States Patent
Nguyen et al.

(10) Patent No.: US 8,106,730 B2
(45) Date of Patent: Jan. 31, 2012

(54) MICROSWITCHING DEVICE AND METHOD OF MANUFACTURING THE SAME

(75) Inventors: Anh Tuan Nguyen, Kawasaki (JP); Tadashi Nakatani, Kawasaki (JP); Satoshi Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 685 days.

(21) Appl. No.: 11/699,378

(22) Filed: Jan. 30, 2007

(65) Prior Publication Data

US 2007/0176717 A1 Aug. 2, 2007

(30) Foreign Application Priority Data

Jan. 31, 2006 (JP) ..... 2006-022720

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,578,976 | A * | 11/1996 | Yao | 333/262 |
| 5,619,061 | A * | 4/1997 | Goldsmith et al. | 257/528 |
| 6,734,770 | B2 * | 5/2004 | Aigner et al. | 335/78 |
| 6,750,742 | B2 * | 6/2004 | Kang et al. | 333/262 |
| 7,123,119 | B2 * | 10/2006 | Pashby et al. | 333/262 |
| 7,151,425 | B2 * | 12/2006 | Park et al. | 333/262 |
| 2003/0183887 | A1 | 10/2003 | Lee et al. | |
| 2003/0227361 | A1 | 12/2003 | Dickens et al. | |
| 2004/0173872 | A1 | 9/2004 | Park et al. | |
| 2005/0183938 | A1 * | 8/2005 | Chou | 200/181 |
| 2005/0225921 | A1 | 10/2005 | Nakatani et al. | 361/160 |
| 2009/0127082 | A1 * | 5/2009 | Zhang et al. | 200/181 |

FOREIGN PATENT DOCUMENTS

| | | |
|---|---|---|
| JP | 2004-1186 | 1/2004 |
| JP | 2004-048176 | 2/2004 |
| JP | 2004-311394 | 11/2004 |
| JP | 2005-251549 | 9/2005 |
| JP | 2005-528751 | 9/2005 |
| JP | 2005-293918 | 10/2005 |

OTHER PUBLICATIONS

Office Action issued in corresponding Korean application dated Aug. 13, 2008.

* cited by examiner

*Primary Examiner* — Bernard Rojas
(74) *Attorney, Agent, or Firm* — Fujitsu Patent Center

(57) ABSTRACT

A microswitching device includes a base, a fixed portion joined to the base, a movable portion extending along the base and having a fixed end fixed to the fixed portion, a movable contact electrode film provided on a side of the movable portion opposite the base, a pair of fixed contact electrodes joined to the fixed portion and having a region opposing the movable contact electrode film, a movable driving electrode film provided on a side of the movable portion opposite the base, and a fixed driving electrode having a region opposing the movable driving electrode film. The movable driving electrode film is thinner than the movable contact electrode film. The fixed driving electrode is joined to the fixed portion joined to the base.

8 Claims, 19 Drawing Sheets

FIG.13

| | Movable Contact Electrode Film Thickness [μm] | Movable Driving Electrode Film Thickness [μm] | Movable Portion Spring Constant [N/m] | Movable Portion Warping Amount [μm] | Minimum Driving Voltage [V] |
|---|---|---|---|---|---|
| EM1 | 0.75 | 0.35 | 24 | 3.3 | 12 |
| EM2 | 0.75 | 0.53 | 40 | 3.5 | 16 |
| CE1 | 0.75 | 0.75 | 40 | Contact Between Contact Electrodes | Measurement Impossible |
| CE2 | 0.75 | 0.75 | 66 | 3.2 | 25 |

MICROSWITCHING DEVICE AND METHOD OF MANUFACTURING THE SAME

BACKGROUND OF THE INVENTION

1. Field of the Invention

The present invention relates to a microswitching device which is manufactured utilizing MEMS technology, and also to a microswitching device manufacturing method utilizing MEMS technology.

2. Description of the Related Art

In the field of portable telephones and other wireless communication equipment, increases in the number of mounted components in order to realize more sophisticated functions have been accompanied by demands for miniaturization of high-frequency circuits and RF circuits. In order to respond to such demands, efforts have been in progress for the miniaturization of various components using MEMS (micro-electro-mechanical systems) technology.

A MEMS switch is a switching device each of the components of which are formed to be very fine, and has at least one pair of contacts which are mechanically opened and closed to execute switching, and a driving mechanism to achieve mechanical open/close operation of the contact pair. MEMS switches tend to exhibit higher insulating properties in the open state, and a lower insertion loss in the closed state, than such switches as PIN diodes and MESFETs, particularly in high-frequency switching in the GHz range. This is because an open state is achieved through mechanical separation of the contact pair, and because there is little stray capacitance due to the fact that the switching is mechanical. MEMS switches are for example described in Japanese Patent Laid-open No. 2004-1186, Japanese Patent Laid-open No. 2004-311394, Japanese Patent Laid-open No. 2005-293918, and National Publication of Translation for PCT Application No. 2005-528751.

FIG. 14 through FIG. 18 show a microswitching device X2, which is an example of conventional microswitching devices. FIG. 14 is a plane view of the microswitching device X2, and FIG. 15 is a partial plane view of the microswitching device X2. FIG. 16 through FIG. 18 are cross-sectional views along lines XVI-XVI, XVII-XVII, and XVIII-XVIII in FIG. 14 respectively.

The microswitching device X2 comprises a base S2, fixed portion 41, movable portion 42, contact electrode 43, pair of contact electrodes 44 (omitted in FIG. 15), driving electrode 45, and driving electrode 46 (omitted in FIG. 15), and is configured as an electrostatic driving device.

The fixed portion 41 is joined to the base S2 with the boundary layer 47 intervening, as shown in FIG. 16 through FIG. 18. The fixed portion 41 and base S2 are made of single-crystal silicon, and the boundary layer 47 is made of silicon dioxide.

As for example shown in FIG. 14, FIG. 15, or FIG. 18, the movable portion 42 has a fixed end 42*a* fixed to the fixed portion 41 and a free end 42*b*, is extended along the base S2, and is surrounded by the fixed portion 41 with a slit 48 intervening. The movable portion 42 is made of single-crystal silicon.

The contact electrode 43 is provided close to the free end 42*b* on the movable portion 42, as shown in FIG. 15. As shown in FIG. 16 and FIG. 18, each of the pair of contact electrodes 44 is provided standing upright on the fixed portion 41, and moreover has a region opposing the contact electrode 43. Each of the contact electrodes 44 is connected to a prescribed circuit for switching via prescribed wiring (not shown).

The driving electrode 45 is provided over the movable portion 42 and fixed portion 41, as shown in FIG. 15. The driving electrode 46 is provided standing upright such that the two ends are joined to the fixed portion 41 and span the driving electrode 45, as shown in FIG. 17. The driving electrode 46 is connected to ground via prescribed wiring (not shown). These driving electrodes 45 and 46 form an electrostatic driving mechanism.

When a prescribed potential is applied to the driving electrode 45 of a microswitching device X2 configured in this way, an electrostatic attractive force occurs between the driving electrodes 45 and 46. As a result, the movable portion 42 is elastically deformed to the position at which the contact electrode 43 makes contact with both the contact electrodes 44. In this way, the closed state of the microswitching device X2 is achieved. In the closed state, the pair of contact electrodes 44 is electrically bridged by the contact electrode 43, so that current is permitted to pass between the contact electrode pair 44. In this way, for example, a high-frequency signal turn-on state can be achieved.

On the other hand, when the microswitching device X2 is in the closed state, by halting the application of a potential to the driving electrode 45 the electrostatic attractive force acting between the driving electrodes 45 and 46 is annihilated, the movable portion 42 returns to its natural state, and the contact electrode 43 is isolated from the contact electrodes 44. In this way, as shown in FIG. 16 and FIG. 18, the open state of the microswitching device X2 is achieved. In the open state, the pair of contact electrodes 44 are electrically separated, and the passage of current between the contact electrode pair 44 is impeded. In this way, for example, a high-frequency signal turn-off state can be achieved.

FIG. 19 through FIG. 21 show a method of manufacture of a microswitching device X2, as changes in cross-sections equivalent to those of FIG. 16 and FIG. 17. In the manufacture of a microswitching device X2, first a material substrate S2' such as shown in FIG. 19A is prepared. The material substrate S2' is a so-called SOI (silicon on insulator) substrate, and has a stacked structure comprising a first layer 51, second layer 52, and intermediate layer 53 between these. The first layer 51 and second layer 52 are made of single-crystal silicon, and the intermediate layer 53 is made of silicon dioxide.

Next, as shown in FIG. 19(*b*), sputtering is used to form a conductive film 54 on the first layer 51. The conductive film 54 has a uniform thickness of 0.75 μm.

Next, as shown in FIG. 19(*c*), the resist patterns 55 and 56 are formed on the conductive film 54. The resist pattern 55 has a pattern shape corresponding to the contact electrode 43. The resist pattern 56 has a pattern shape corresponding to the driving electrode 45.

Next, as shown in FIG. 20(*a*), the resist patterns 55 and 56 are used as masks to perform etching on the conductive film 54, in order to form the contact electrode 43 and driving electrode 45 on the first layer 51. The contact electrode 43 and driving electrode 45 formed in this way have the same thickness of 0.75 μm.

Next, after removing the resist patterns 55 and 56, etching on the first layer 51 is performed to form the slit 48, as shown in FIG. 20(*b*). Specifically, photolithography is used to form a prescribed resist pattern (not shown) on the first layer 51, after which the resist pattern is used as a mask to perform etching on the first layer 51. In this process, the fixed portion 41 and movable portion 42 are patterned and formed.

Next, as shown in FIG. 20(*c*), a sacrificial layer 57 is formed on the substrate S2', on the side of the first layer 51, so as to fill the slit 48. The sacrificial layer 57 is made of silicon dioxide. In this process, the sacrificial layer material is deposited on a portion of the side walls of the slit 48 as well, to fill the slit 48. By adjusting the thickness of the sacrificial layer 57 formed in this process, it is possible to adjust the isolation distance in the open state between the contact electrodes 43 and 44 and between the contact electrodes 45 and 46 in the microswitching device X2 obtained. The thickness of the sacrificial layer 57 is set to 5 μm or less. This is because if the thickness of the sacrificial layer 57 exceeds 5 μm, then internal stresses occurring within the sacrificial layer 57 may result in improper warping of the material substrate S2', and cracks tend to occur in the sacrificial layer 57.

Next, as shown in FIG. 21(*a*), the sacrificial layer 57 is patterned to form opening portions 57*a* and 57*b*. The opening portion 57*a* is provided to expose the area of the fixed portion 41 to which the contact electrode 44 is to be joined. The opening portion 57*b* is provided to expose the area of the fixed portion 41 to which the driving electrode 46 is to be joined.

Next, a prescribed resist pattern (not shown) formed on the sacrificial layer 57 is used as a mask to perform electroplating, to form the pair of contact electrodes 44 and the driving electrode 46, as shown in FIG. 21(*b*).

Next, as shown in FIG. 21(*c*), wet etching is performed to remove the sacrificial layer 57 and a portion of the intermediate layer 53. In this etching process, first the sacrificial layer 57 is removed, and then a portion of the intermediate layer 53 is removed from the location bordering the slit 48. This etching is halted after an appropriate gap is formed between the entirety of the movable portion 42 and the second layer 52. In this way, the above-described boundary layer 47 is formed to remain in the intermediate layer 53. The second layer 52 forms the base S2. By means of the above processes, an electrostatic-driving type microswitching device X2 is formed.

A small driving voltage is one characteristic which is strongly demanded of an electrostatic-driving type switching device. In order to reduce the driving voltage of the microswitching device X2, it is useful to make the movable portion 42 thin and to design the movable portion 42 to have a small spring constant.

On the other hand, a low insertion loss for signals passed by the contact electrodes in the closed state is generally demanded of switching devices. In order to lower the insertion loss of the switching device, it is useful to set make the contact electrodes thick and design the contact electrodes to have low resistance.

However, in a microswitching device X2 of the prior art, there is a tendency toward increasing difficulty in reducing the resistance of the contact electrode 43. This is because in the microswitching device X2, the contact electrode 43 cannot readily be made thick due to the need to lower the driving voltage, as described above.

As explained above referring to FIG. 19(*b*), (*c*), the contact electrode 43 and driving electrode 45 are formed by patterning from the conductive film 54 of uniform thickness formed on the first layer 51, and have the same thickness. As a result, if a large thickness is chosen for the contact electrode 43 so as to reduce the resistance of the contact electrode 43, the driving electrode 45 also has a large thickness. The larger the thickness of the driving electrode 45, the larger is the internal stress which occurs so as to shrink the driving electrode 45, and consequently the action of the internal stress causes the movable portion 42 to be deformed improperly, tending to result in the problem of warping on the side of the contact electrode 44 and driving electrode 46. Such warping of the movable portion 42 impedes the switching function of the microswitching device X2, and induces degradation of various characteristics, and so is undesirable. For example, due to warping of the movable portion 42, there are cases in which the contact electrodes 43 and 44 come into contact even when there is no driving (when no voltage is applied across the driving electrodes 45 and 46), and there are cases in which the driving electrodes 45 and 46 are always in contact. In order to avoid such states, it is necessary to reduce the thickness of the driving electrode 45 and of the contact electrode 43 formed to the same thickness as the driving electrode 45, relative to the thickness of the movable portion 42, which is set to a prescribed small value from the standpoint of reducing the driving voltage. Specifically, it is necessary to make the driving electrode 45 and contact electrode 43 thin, so as to suppress warping of the movable portion 42, within the limits of the isolation distance between the movable portion 42 and the contact electrode 44 and the isolation distance between the movable portion 42 and the driving electrode 46, which can be realized utilizing the sacrificial layer 57 formed to a thickness of 5 μm or less as described above.

Thus when using the technology of the prior art for microswitching devices, there are cases in which it is difficult to realize a sufficiently low-resistance contact electrode and reduce insertion losses while keeping the device driving voltage low.

SUMMARY OF THE INVENTION

The present invention has been proposed in light of the above circumstances. It is an object of the present invention to provide a microswitching device and a method of manufacture thereof, suitable for reducing insertion losses and driving voltage.

According to a first aspect of the present invention, a microswitching device is provided. The microswitching device comprises a base; a fixed portion joined to the base; a movable portion extending along the base and having a fixed end fixed to the fixed portion; a movable contact electrode film, provided on the side of the movable portion opposite the base; and a pair of fixed contact electrodes, each joined to the fixed portion and each having a region opposing the movable contact electrode film. The microswitching device also comprises a movable driving electrode film, provided at least on the side of the movable portion opposite the base, and thinner than the movable contact electrode film, and a fixed driving electrode, having a region opposing the movable driving electrode film and joined to the fixed portion.

In a microswitching device with such a configuration, the movable contact electrode film and the movable driving electrode film do not have the same thickness, and moreover the movable driving electrode film is thinner than the movable contact electrode film. As a result, in this device the movable driving electrode film can be set sufficiently thin compared with the thickness of the movable portion, which is set to a prescribed small value in order to reduce the driving voltage, and in addition the movable contact electrode film can be set to a large thickness in order to lower the resistance of the movable contact electrode film. The lower the resistance of the movable contact electrode film, the smaller the insertion loss of the microswitching element will tend to be. Hence this microswitching element is suitable for reducing the driving voltage and lowering the insertion loss.

Preferably the movable contact electrode film may be positioned further from the fixed end of the movable portion than the movable driving electrode film. By means of such a configuration, a relatively large displacement of the movable contact electrode film with respect to the fixed contact electrode can be realized for a relatively small displacement of the movable driving electrode film with respect to the fixed driving electrode. Hence this configuration is suitable for reducing the improving the efficiency of device driving or for lowering the driving voltage.

Preferably the thickness of the movable driving electrode film may be 0.53 μm or less. Such a thickness range for the movable driving electrode film is suitable for suppressing warping of the movable portion, and so is suitable for lowering the device driving voltage.

Preferably the thickness of the movable contact electrode film may be from 0.5 to 2.0 μm. This thickness range for the movable contact electrode film is suitable for lowering the resistance of the movable contact electrode film.

Preferably the spring constant of the movable portion may be 40 N/m or less. This spring constant range for the movable portion is suitable for lowering the driving voltage of the device.

According to a second aspect of the present invention, a method is provided for the manufacture of a microswitching device which comprises a base; a fixed portion, joined to the base; a movable portion, extended along the base, and having a fixed end fixed to the fixed portion; a movable contact electrode film and movable driving electrode film, provided on the side of the movable portion opposite the base; a pair of fixed contact electrodes, each joined to the fixed portion and each having a region opposing the movable contact electrode film; and a fixed driving electrode, having a region opposing the movable driving electrode film, and joined to the fixed portion. The method comprises the following steps. First, a material substrate is prepared which has a stacked structure consisting of e.g. a first layer, a second layer, and an intermediate layer between the first and second layers. Then, a conductive film is formed on the first layer. A movable contact electrode film and a movable driving electrode film precursor are formed by patterning the conductive film. A movable driving electrode film which is thinner than the movable contact electrode film is formed by performing etching on the movable driving electrode film precursor. This method is suitable for manufacturing the microswitching device of the above-described first aspect, comprising on the movable portion a movable contact electrode film and a movable driving electrode film thinner than the movable contact electrode film.

According to a third aspect of the present invention, another method is provided for the manufacture, by processing of a material substrate having a stacked structure comprising a first layer, a second layer, and an intermediate layer between the first and second layers, of the above-mentioned microswitching device. This method includes the following steps. First, a material substrate is prepared which has a stacked structure consisting of e.g. a first layer, a second layer, and an intermediate layer between the first and second layers. Then, a conductive film is formed on the first layer. On the conductive film is formed a first mask pattern having a pattern shape corresponding to the movable contact electrode film. Using the first mask pattern, etching is performed on the conductive film until partway in the thickness direction of the conductive film. On the conductive film a second mask pattern is formed which has a pattern shape corresponding to the movable driving electrode film. Using the first and second mask patterns, etching is performed on the conductive film, to form a movable contact electrode film and a movable driving electrode film which is thinner than the movable contact electrode film. This method is suitable for manufacturing the microswitching device of the above-described first aspect, comprising on the movable portion a movable contact electrode film and a movable driving electrode film thinner than the movable contact electrode film.

The methods of the second and third aspects of the invention further comprise a process of using a prescribed resist pattern as a mask to perform, for example, anisotropic etching on the first layer, to form a movable portion and a fixed portion in the first layer; a process of forming a sacrificial layer, covering the first-layer side and having at least two opening portions to expose fixed contact electrode joining areas in the fixed portion and at least one opening portion to expose a fixed driving electrode joining area in the fixed portion; a process of forming fixed contact electrodes, each having a region opposing the movable contact electrode film with the sacrificial film intervening and each joined to the fixed portion at a fixed contact electrode joining area, and of forming a fixed driving electrode having a region opposing the movable driving electrode film with the sacrificial film intervening and joined to the fixed portion at the fixed driving electrode joining area; and a process of removing the sacrificial layer, and the regions of the intermediate layer between the second layer and the movable portion, for example by wet etching. By means of this configuration, the movable portion, fixed portion, fixed contact electrodes, and fixed driving electrode in the microswitching device of the first aspect can be appropriately formed.

BRIEF DESCRIPTION OF THE DRAWINGS

FIG. 13 is a table summarizing the thickness of the movable contact electrode film, thickness of the movable driving electrode film, movable portion spring constant, amount of warping of movable portion, and minimum driving voltage, in Embodiments 1 and 2 and in Comparison Examples 1 and 2;

DETAILED DESCRIPTION OF THE PREFERRED EMBODIMENTS

Figure 1:
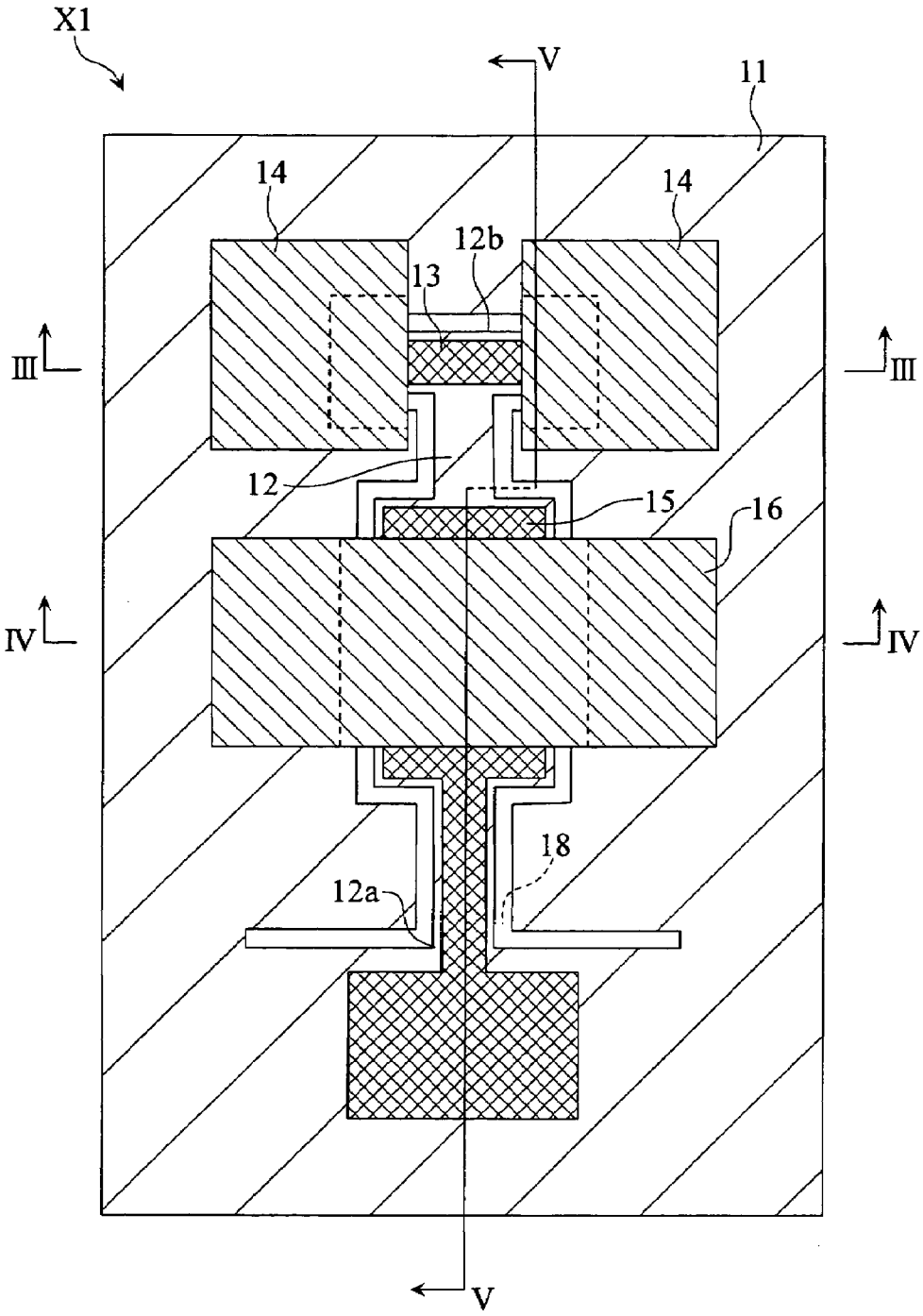
FIG. 1 is a plane view of a microswitching device of the present invention.
Figure 2:
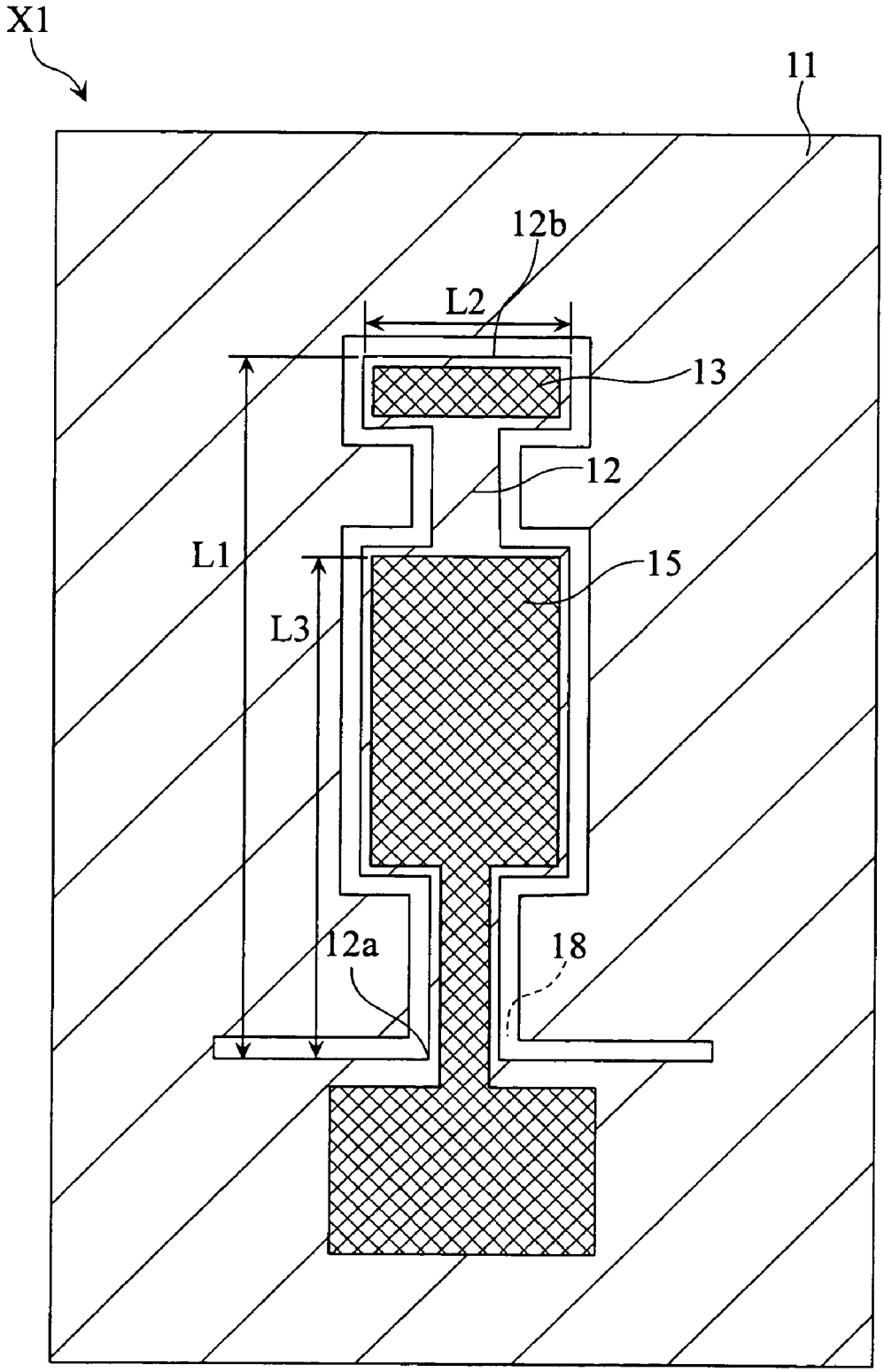
FIG. 2 is a partial plane view of the microswitching device shown in FIG. 1.
Figure 3:
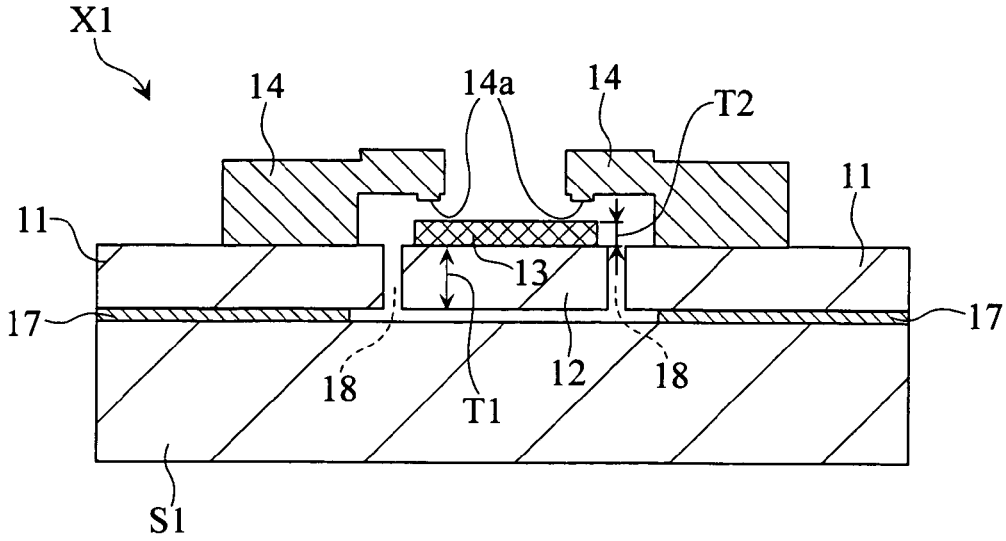
FIG. 3 is a cross-sectional view along line III-III in FIG. 1.
Figure 4:
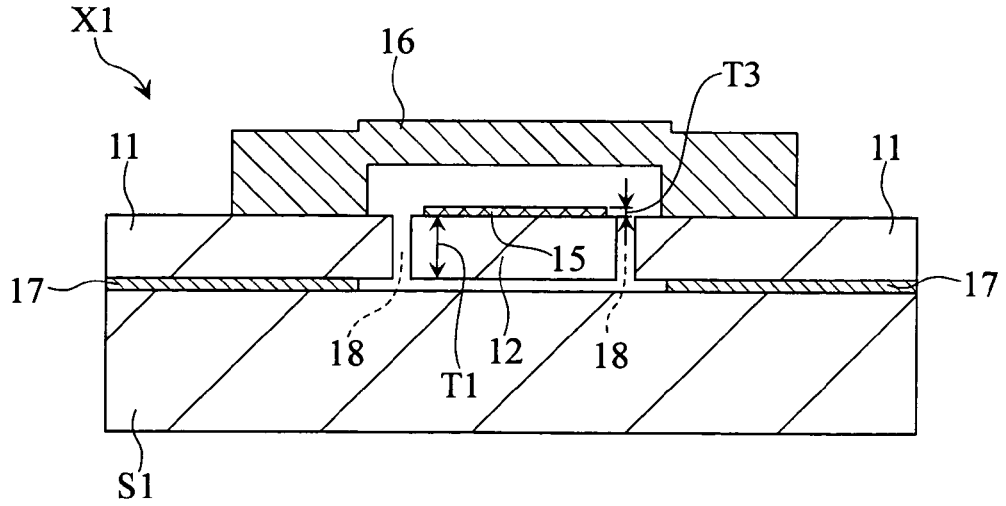
FIG. 4 is a cross-sectional view along line IV-IV in FIG. 1.
Figure 5:
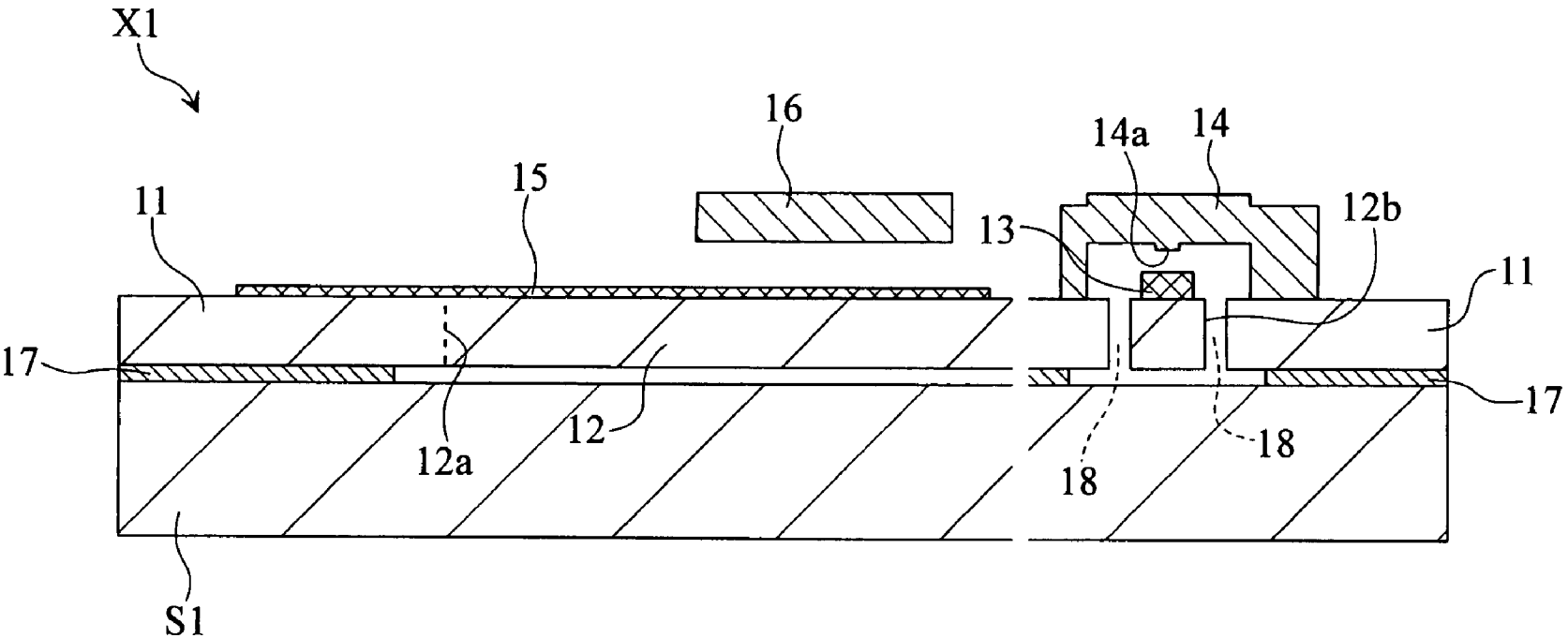
FIG. 5 is a cross-sectional view along line V-V in FIG. 1.

FIG. 1 through FIG. 5 show a microswitching device X1 of the present invention. FIG. 1 is a plane view of the microswitching device X1, and FIG. 2 is a partial plane view of the microswitching device X1. FIG. 3 through FIG. 5 are cross-sectional views along line III-III, line IV-IV, and line V-V respectively in FIG. 1.

The microswitching device X1 comprises a base S1, fixed portion 11, movable portion 12, contact electrode 13, pair of contact electrodes 14 (omitted in FIG. 2), driving electrode 15, and driving electrode 16 (omitted in FIG. 2), and is configured as an electrostatic driving-type device.

As shown in FIG. 3 through FIG. 5, the fixed portion 11 is joined to the base S1 with the boundary layer 17 intervening. The fixed portion 11 is made of single-crystal silicon or another silicon material. Preferably the silicon material of the fixed portion 11 may have a resistivity of 1000 Ω·cm or higher (in other words, no smaller than 1000 Ω·cm). The boundary layer 17 is made of for example silicon dioxide.

As for example shown in FIG. 1, FIG. 2, or FIG. 5, the movable portion 12 has a fixed end 12*a* fixed to the fixed portion 11 and a free end 12*b*, extends along the base S1, and is surrounded by the fixed portion 11 with a slit 18 intervening. Preferably the spring constant of the movable portion 12 may be 40 N/m or less (in other words, no greater than 40 N/m). This spring constant range for the movable portion 12 is suitable for lowering the driving voltage of the device. In order to realize a spring constant of 40 N/m or less, the thickness T1 shown in FIG. 3 and FIG. 4 for the movable portion 12 is for example 15 μm or less. The length L1 shown in FIG. 2 for the movable portion 12 is for example 650 to 1000 μm, and the length L2 is for example 100 to 200 μm. The width of the slit 18 is for example 1.5 to 2.5 μm. The movable portion 12 is made of for example single-crystal silicon. When the movable portion 12 is made of single-crystal silicon, no improper stresses occur in the movable portion 12 itself.

The contact electrode 13 is a movable contact electrode film, and as is clearly shown in FIG. 2, is provided close to the free end 12*b* of the movable portion 12. The thickness T2 shown in FIG. 3 for the contact electrode 13 is from 0.5 to 2.0 μm. This range for the thickness T2 is preferable for lowering the resistance of the contact electrode 13. The control electrode 13 is made of a prescribed conductive material, and for example has a stacked structure comprising a Mo underlayer and an Au film on top.

Each of the pair of contact electrodes 14 is a fixed contact electrode, and as shown in FIG. 3 and FIG. 5, is provided standing upright on the fixed portion 11, and has a contact portion 14*a* opposing the contact electrode 13. The thickness of the contact electrodes 14 is for example 15 μm or greater. Each of the contact electrodes 14 is connected to a prescribed circuit for switching via prescribed wiring (not shown). As the constituent material of the contact electrodes 14, the same material as the constituent material of the contact electrode 13 can be used.

The driving electrode 15 is a movable driving electrode film, and as is clearly shown in FIG. 2, is provided over the movable portion 12 and fixed portion 11. The thickness T3 shown in FIG. 4 for the driving electrode 15 is 0.53 μm or less, with the constraint that the thickness is smaller than the thickness T2 of the contact electrode 13. The length L3 shown in FIG. 2 for the driving electrode 15 on the movable portion 12 is for example from 550 to 900 μm. As the constituent material of the driving electrode 15, the same material as the constituent material of the contact electrode 13 can be used.

The driving electrode 16 is a fixed driving electrode, and as is clearly shown in FIG. 4, has both ends joined to the fixed portion 11 and is provided standing upright so as to span the driving electrode 15. The thickness of the driving electrode 16 is for example 15 μm or greater. The driving electrode 16 is connected to ground via prescribed wiring (not shown). As the constituent material of the driving electrode 16, the same material as the constituent material of the contact electrode 13 can be used.

In a microswitching device X1 configured in this way, when a prescribed potential is applied to the driving electrode 15, an electrostatic attractive force arises between the driving electrodes 15 and 16. As a result, the movable portion 12 is elastically deformed to the position at which the contact electrode 13 makes contact with the pair of contact electrodes 14 or contact portions 14*a*. By this means, the closed state of the microswitching device X1 is achieved. In the closed state, the pair of contact electrodes 14 is electrically bridged by the contact electrode 13, and current is permitted to pass between the contact electrodes 14. In this way, for example, a high-frequency signal turn-on state can be achieved.

In a microswitching device X1 in the closed state, by halting the provision of the potential to the driving electrode 15 the electrostatic attractive force acting between the driving electrodes 15 and 16 is annihilated, the movable portion 12 returns to its natural state, and the contact electrode 13 is isolated from the pair of contact electrodes 14. In this way, the open state of the microswitching device X1, such as shown in FIG. 3 and FIG. 5, is achieved. In the open state, the pair of contact electrodes 14 are electrically separated, and the passage of current between the pair of contact electrodes 14 is prevented. In this way, for example, a high-frequency signal turn-off state can be achieved.

In the microswitching device X1, the contact electrode 13 and the driving electrode 15 do not have the same thickness, and moreover the driving electrode 15 is thinner than the contact electrode 13 (the thickness T3 of the driving electrode 15 is 0.53 μm or less, with the constraint that T3 is smaller than the thickness T2 of the contact electrode 13). Consequently, in the microswitching device X1, the driving electrode 15 can be set to a sufficiently smaller thickness T3 than the thickness T1 of the movable portion 12, which is set to a prescribed small value in order to lower the driving voltage, and in addition, the thickness T2 of the contact electrode 13 can be set to a sufficiently large value to lower the resistance of the contact electrode 13. The lower the resistance of the contact electrode 13, the smaller the insertion loss of the microswitching device X1 tends to be. Hence both the driving voltage and the insertion loss of the microswitching device X1 can be lowered appropriately.

In the microswitching device X1, the contact electrode 13 is positioned further from the fixed end 12*a* of the movable portion 12 than the driving electrode 15. By means of such a configuration, a relatively large displacement of the contact electrode 13 with respect to the contact electrode 14 can be realized for a relatively small displacement of the driving electrode 15 with respect to the driving electrode 16. Hence the efficiency of device driving of the microswitching device X1 can be enhanced, or the driving voltage can be lowered appropriately.

Figure 6:
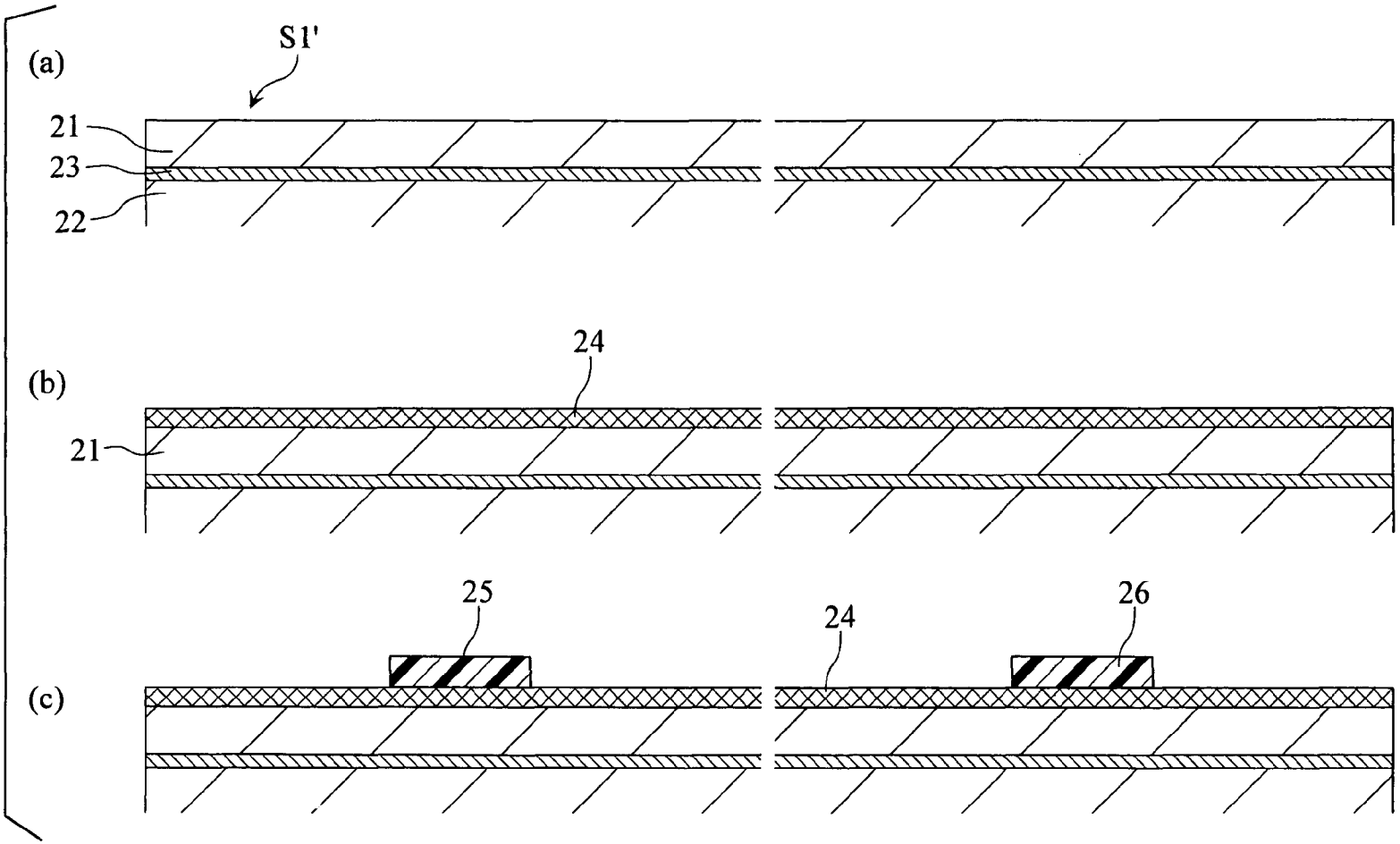
FIG. 6 shows steps in a first method of manufacture of the microswitching device shown in FIG. 1.

FIG. 6 through FIG. 10 show a first method of manufacture of the microswitching device X1, as changes in the cross-section equivalent to FIG. 3 and FIG. 4. In this method, first a material substrate S1' such as shown in FIG. 6(*a*) is prepared. The substrate S1' is a SOI (silicon on insulator) substrate, having a stacked structure comprising a first layer 21, second layer 22, and intermediate layer 23 between these. For instance, the thickness of the first layer 21 is 15 μm, the thickness of the second layer 22 is 525 μm, and the thickness of the intermediate layer 23 is 4 μm. The first layer 21 is made of for example single-crystal silicon, and is processed to obtain the fixed portion 11 and movable portion 12. The second layer 22 is made of for example single-crystal silicon, and is processed to obtain the base S1. The intermediate layer 23 is made of for example silicon dioxide, and is processed to obtain the boundary layer 17.

Next, as shown in FIG. 6(*b*), a conductive film 24 is formed on the first layer 21. For example, a sputtering method is used to deposit Mo on the first layer 21, and then to deposit Au thereupon. The thickness of the Mo film is for example 30 nm, and the thickness of the Au film is for example 500 nm.

Next, as shown in FIG. 6(*c*), photolithography is used to form resist patterns 25 and 26 on the conductive film 24. The resist pattern 25 has a pattern shape corresponding to the contact electrode 13. The resist pattern 26 has a pattern shape corresponding to the driving electrode 15.

Figure 7:
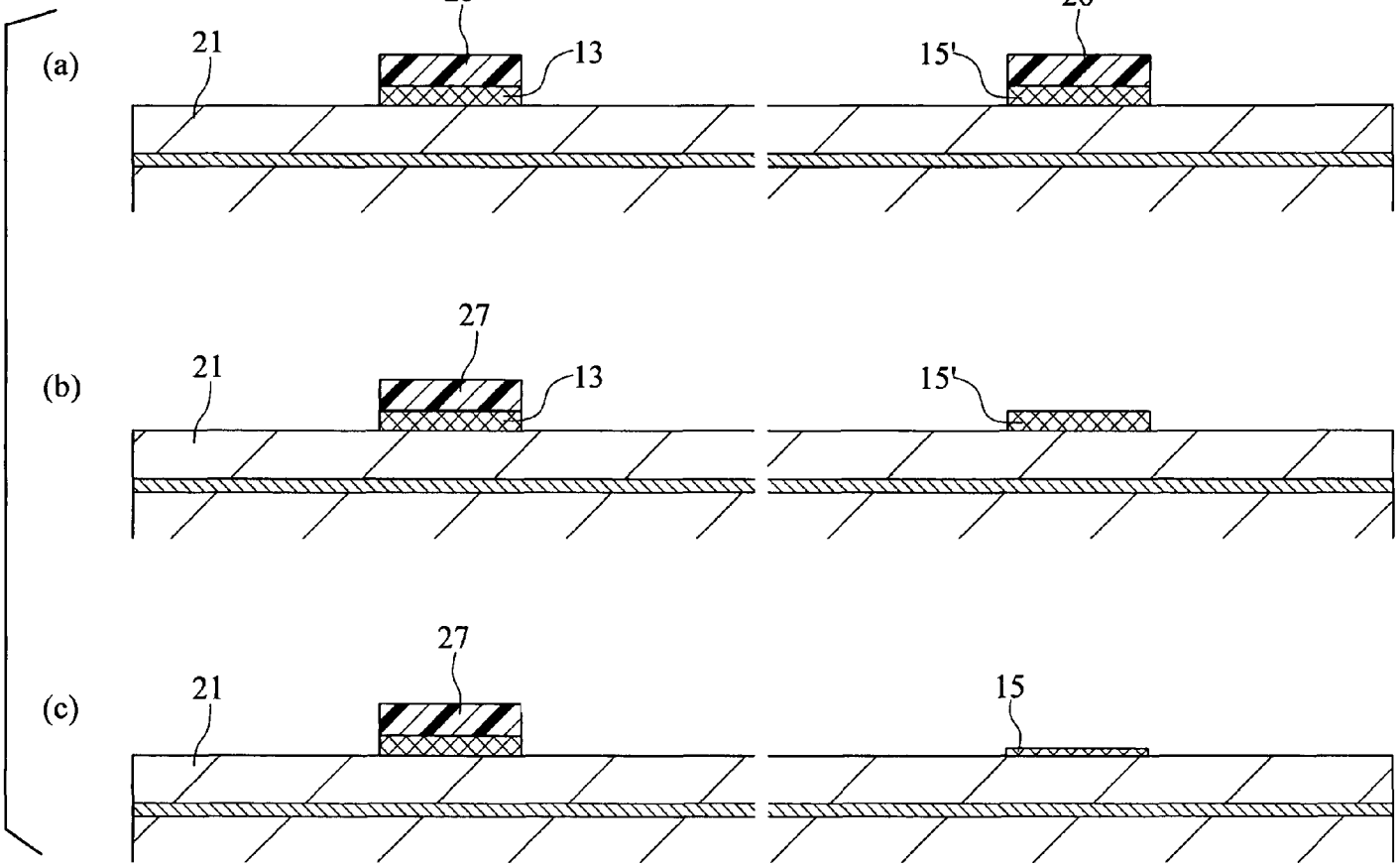
FIG. 7 shows steps following those of FIG. 6.

Next, as shown in FIG. 7(*a*), the resist patterns 25 and 26 are used as masks to perform etching on the conductive film 24, to form the contact electrode 13 and driving electrode precursor 15' on the first layer 21. The driving electrode precursor 15' is a movable driving electrode film precursor. As the etching method used in this process, ion milling (for example, physical etching by Ar ions) can be employed. Ion milling can also be used as the method of subsequent etching on metal material.

Next, after the resist patterns 25 and 26 which have been subjected to etching and degraded are removed, photolithography is used to form a resist pattern 27 on the contact electrode 13, as shown in FIG. 7(*b*).

Next, as shown in FIG. 7(*c*), the resist pattern 27 is used as a mask to perform etching to a prescribed degree of the driving electrode precursor 15', in order to form the driving electrode 15. In this process, the driving electrode 15, which is thinner than the contact electrode 13, is formed on the first layer 21.

Figure 8:
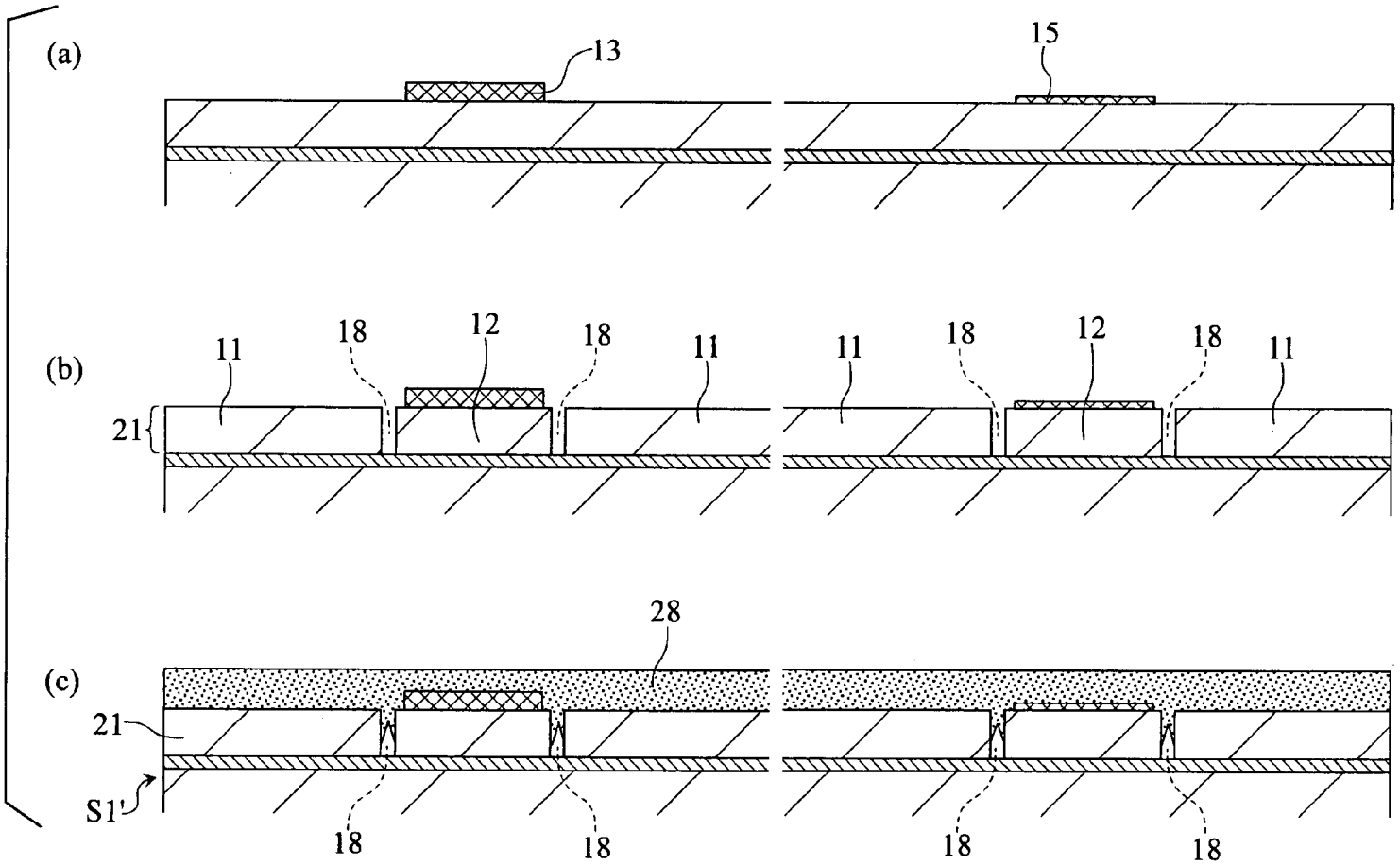
FIG. 8 shows steps following those of FIG. 7.

Next, after removing the resist pattern 27 as shown in FIG. 8(*a*), a slit 18 is formed by etching of the first layer 21 as in FIG. 8(*b*). Specifically, after forming a prescribed resist pattern on the first layer 21 by photolithography, the resist pattern is used as a mask to perform anisotropic etching on the first layer 21. As the etching method, reactive ion etching can be used. In this process, the fixed portion 11 and movable portion 12 are patterned and formed.

Next, as shown in FIG. 8(*c*), a sacrificial layer 28 is formed on the material substrate S1' on the side of the first layer 21 so as to fill the slit 18. As the sacrificial layer material, for example silicon dioxide can be used. As the method used to form the sacrificial layer 28, for example, plasma CVD or a sputtering method can be used. By adjusting the thickness of the sacrificial layer 28 formed in this process, the isolation distances in the open state between the contact electrodes 13 and 14 and between the driving electrodes 15 and 16 in the microswitching device X1 which is finally obtained can be adjusted. However, the thickness of the sacrificial layer 28 is set to 5 μm or less. This is because, if the thickness of the sacrificial layer 28 exceeds 5 μm, internal stresses occurring within the sacrificial layer 28 may cause improper warping of the material substrate S1', and cracks tend to occur in the sacrificial layer 28.

Figure 9:
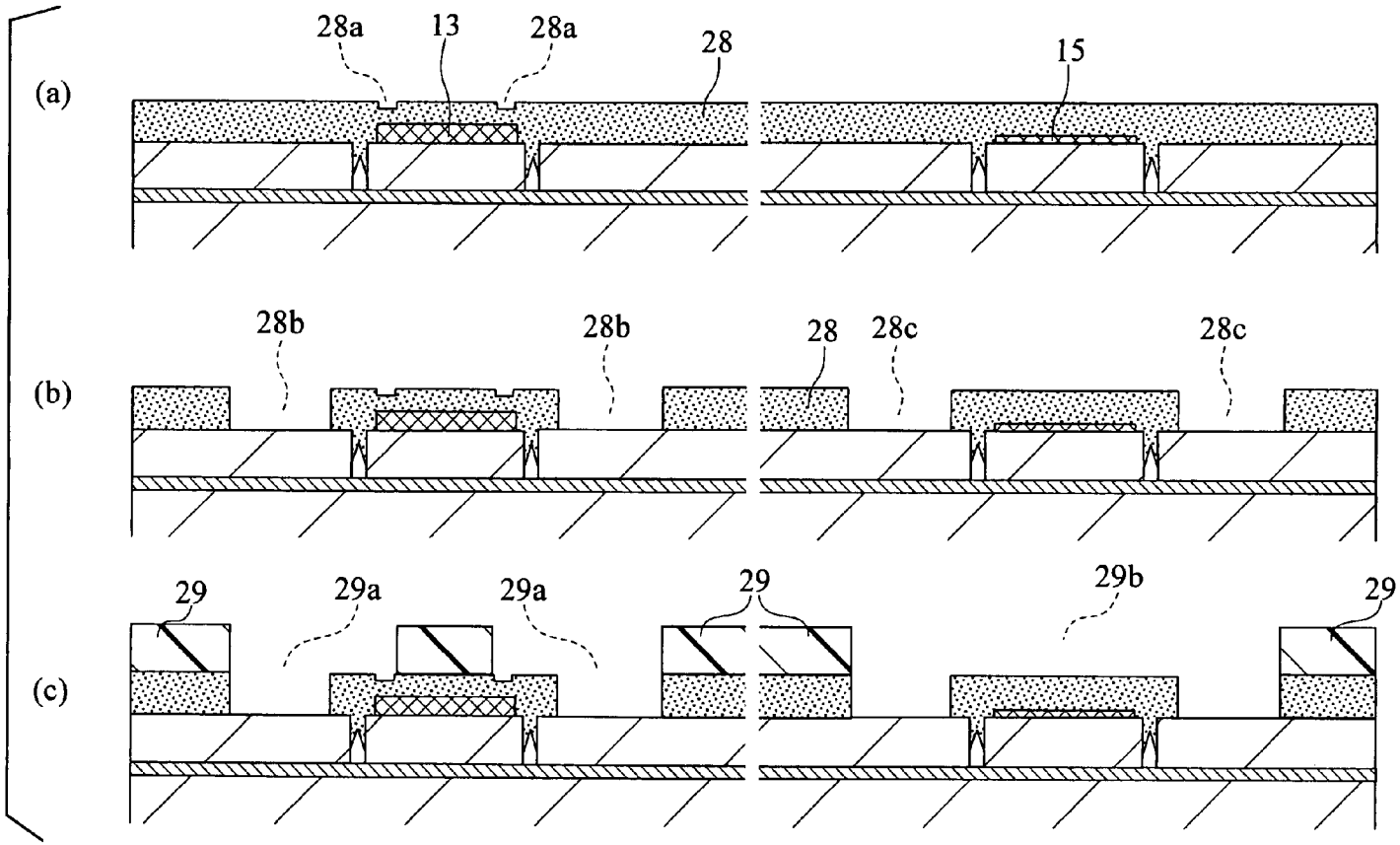
FIG. 9 shows steps following those of FIG. 8.

Next, as shown in FIG. 9(*a*), two depressions 28*a* are formed at prescribed locations in the sacrificial layer 28 corresponding to the contact electrode 13. Specifically, after photolithography is used to form a prescribed resist pattern on the sacrificial layer 28, the resist pattern is used as a mask to perform etching on the sacrificial layer 28. As the etching method, wet etching can be used. As the etching liquid for the wet etching, for example, buffered hydrofluoric acid (BHF) can be used. BHF can also be used in subsequent wet etching of the sacrificial layer 28. Each of the depressions 28*a* is provided to form a contact portion 14*a* of a contact electrode 14, and has a depth of for example 1 μm. By adjusting the depth of the depressions 28*a*, the distance between the movable portion 12 or contact electrode 13 and the contact electrodes 14 can be adjusted. In this process, a depression of prescribed depth may also be formed at a location in the sacrificial layer 28 corresponding to the driving electrode 15. By adjusting the depth of this depression, the distance between the movable portion 12 or driving electrode 15 and the driving electrode 16 can be adjusted (the shorter the distance, the lower the device driving voltage tends to be). The depth of the depression is for example 0.5 μm.

Next, as shown in FIG. 9(*b*), the sacrificial layer 28 is patterned to form openings 28*b* and 28*c*. Specifically, after using photolithography to form a prescribed resist pattern on the sacrificial layer 28, the resist pattern is used as a mask to perform etching on the sacrificial layer 28. As the etching method, wet etching can be used. The opening 28*b* is provided to expose an area in the fixed portion 11 to be joined to the contact electrode 14 (fixed contact electrode joining area). The opening 28*c* is provided to expose an area in the fixed portion 11 to be joined to the driving electrode 16 (fixed driving electrode joining area).

Next, after forming an underlayer (not shown) for passing current on the surface of the material substrate S1' on the side on which the sacrificial layer 28 is provided, a resist pattern 29 is formed as shown in FIG. 9(*c*). The underlayer can for example be formed by depositing Mo to a thickness of 50 nm using sputtering, and then depositing Au to a thickness of 500 nm thereupon. The resist pattern 29 has an opening 29*a* corresponding to the pair of contact electrodes 14 and an opening 29*b* corresponding to the driving electrode 16.

Figure 10:
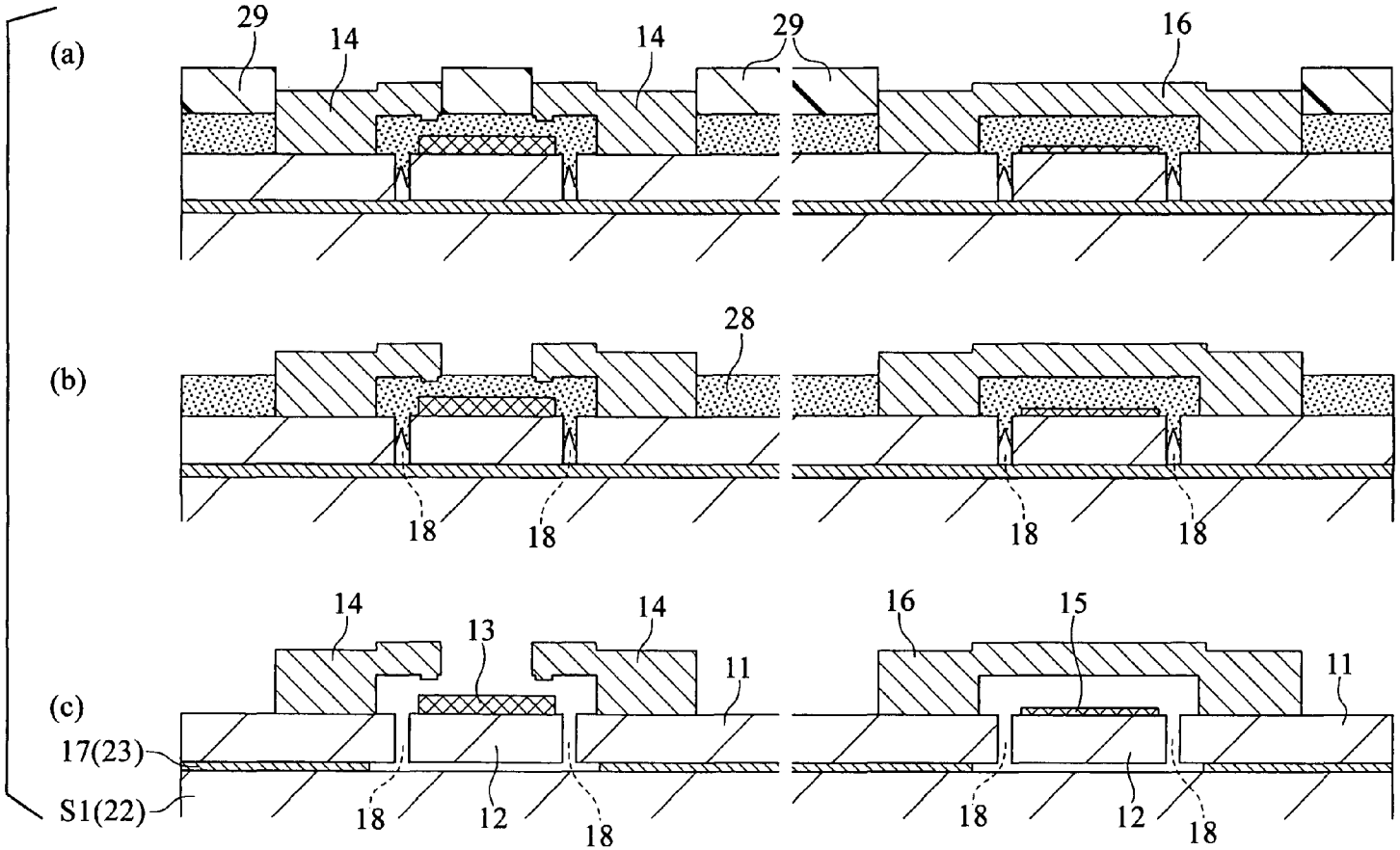
FIG. 10 shows steps following those of FIG. 9.

Next, as shown in FIG. 10(*a*), the pair of contact electrodes 14 and the driving electrode 16 are formed. Specifically, electroplating is used to grow, for example, gold on the underlayer exposed by the openings 28*b*, 28*c*, 29*a* and 29*b*.

Next, as shown in FIG. 10(*b*), the resist pattern 29 is removed by etching. Thereafter, the portion of the above-described underlayer used for electroplating which is exposed is removed by etching. Wet etching can be used to etch and remove these portions.

Next, as shown in FIG. 10(*c*), the sacrificial layer 28 and a portion of the intermediate layer 23 are removed. Specifically, wet etching of the sacrificial layer 28 and intermediate layer 23 is performed. In this etching treatment, first the sacrificial layer 28 is removed, and then a portion of the intermediate layer 23 is removed from the location bordering the slit 18. This etching is halted after an appropriate gap has been formed between the entirety of the movable portion 12 and the second layer 22. In this way, the boundary layer 17 remains and is formed in the intermediate layer 23. The second layer 22 forms the base S1.

Next, after using wet etching to remove as necessary a portion of the underlayer (for example Mo film) adhering to the lower surface of the contact electrode 14 and driving electrode 16, a supercritical drying method is used to dry the entire device. By means of a supercritical drying method, a sticking phenomenon, in which the movable portion 12 adheres to the base S1 or similar, can be avoided.

By means of the above method, the microswitching device X1 shown in FIG. 1 through FIG. 5 can be manufactured. Through the above-described method, a microswitching device X1 comprising, on the movable portion 12, a contact electrode 13 and a driving electrode 15 thinner than the contact electrode 13 can be appropriately manufactured.

Further, in the above-described method a plating method can be used to form, on the sacrificial layer 28, thick contact electrodes 14 having contact portions 14*a* opposing the contact electrode 13. As a result, the pair of contact electrodes 14 can be made sufficiently thick to realize the desired low resistance. Thick contact electrodes 14 are preferable in order to reduce the insertion loss of the microswitching device X1.

Figure 11:
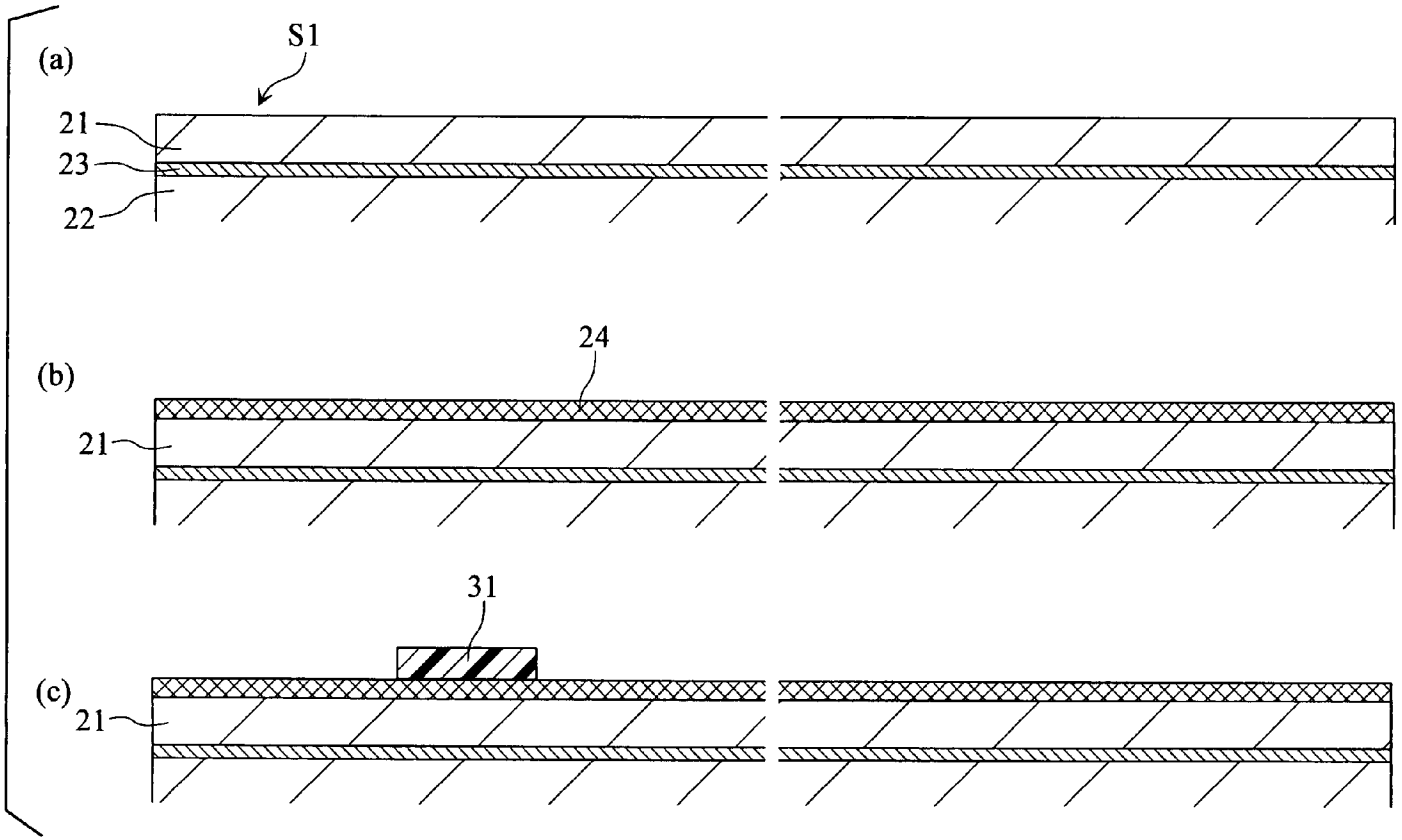
FIG. 11 shows steps in a second method of manufacture of the microswitching device shown in FIG. 1.
Figure 12:
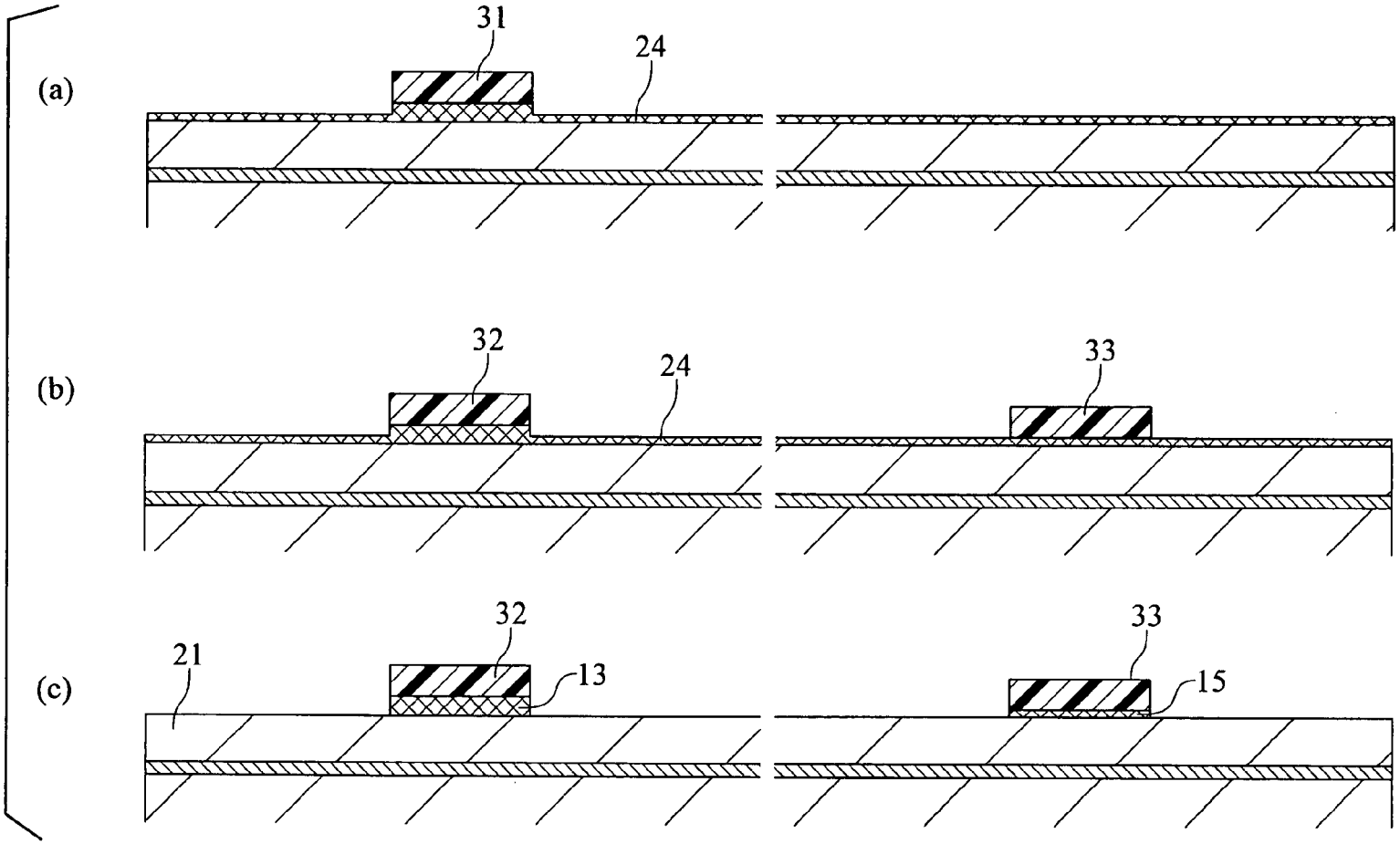
FIG. 12 shows steps following those of FIG. 11.
Figure 14:
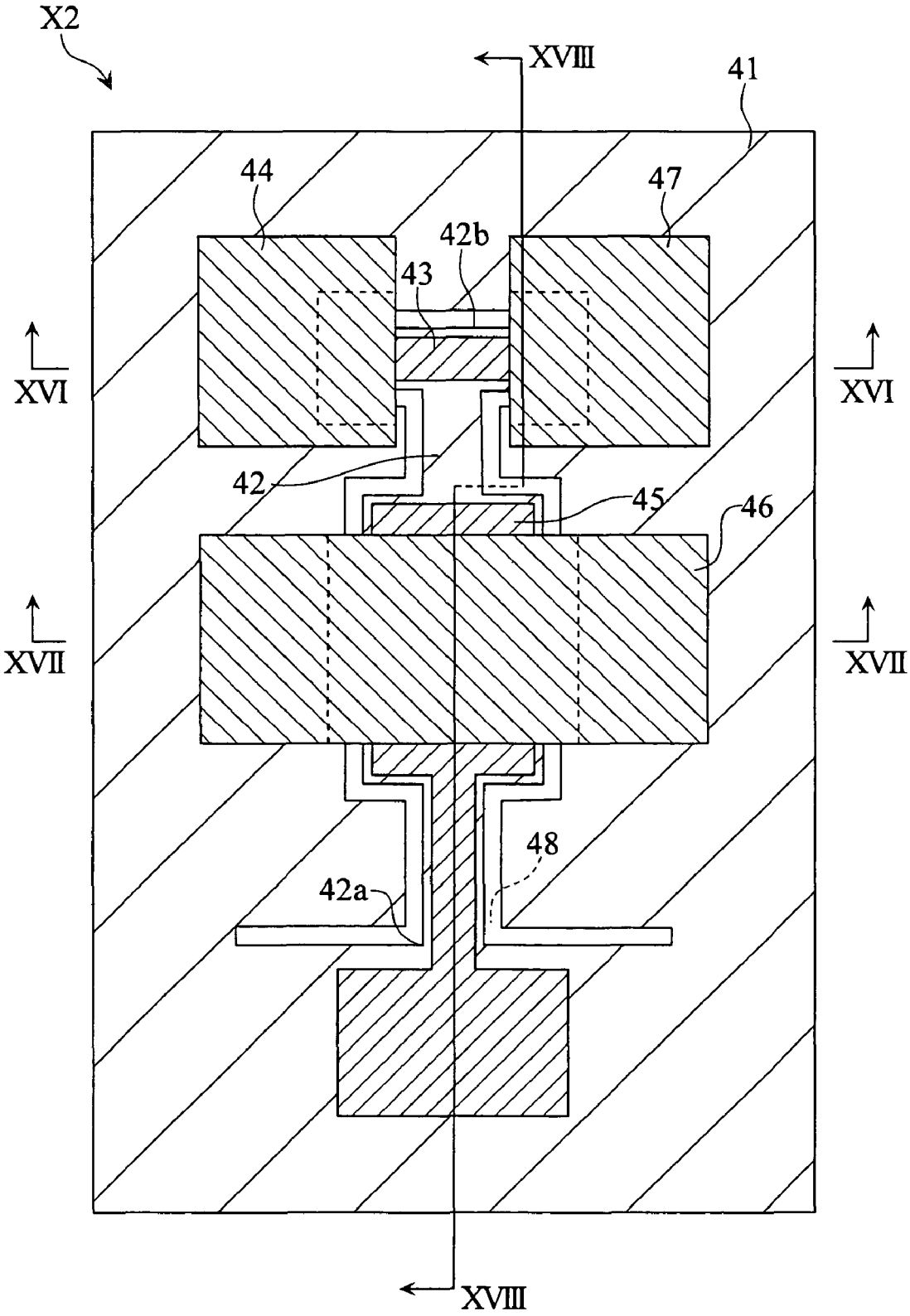
FIG. 14 is a plane view of a conventional microswitching device.
Figure 15:
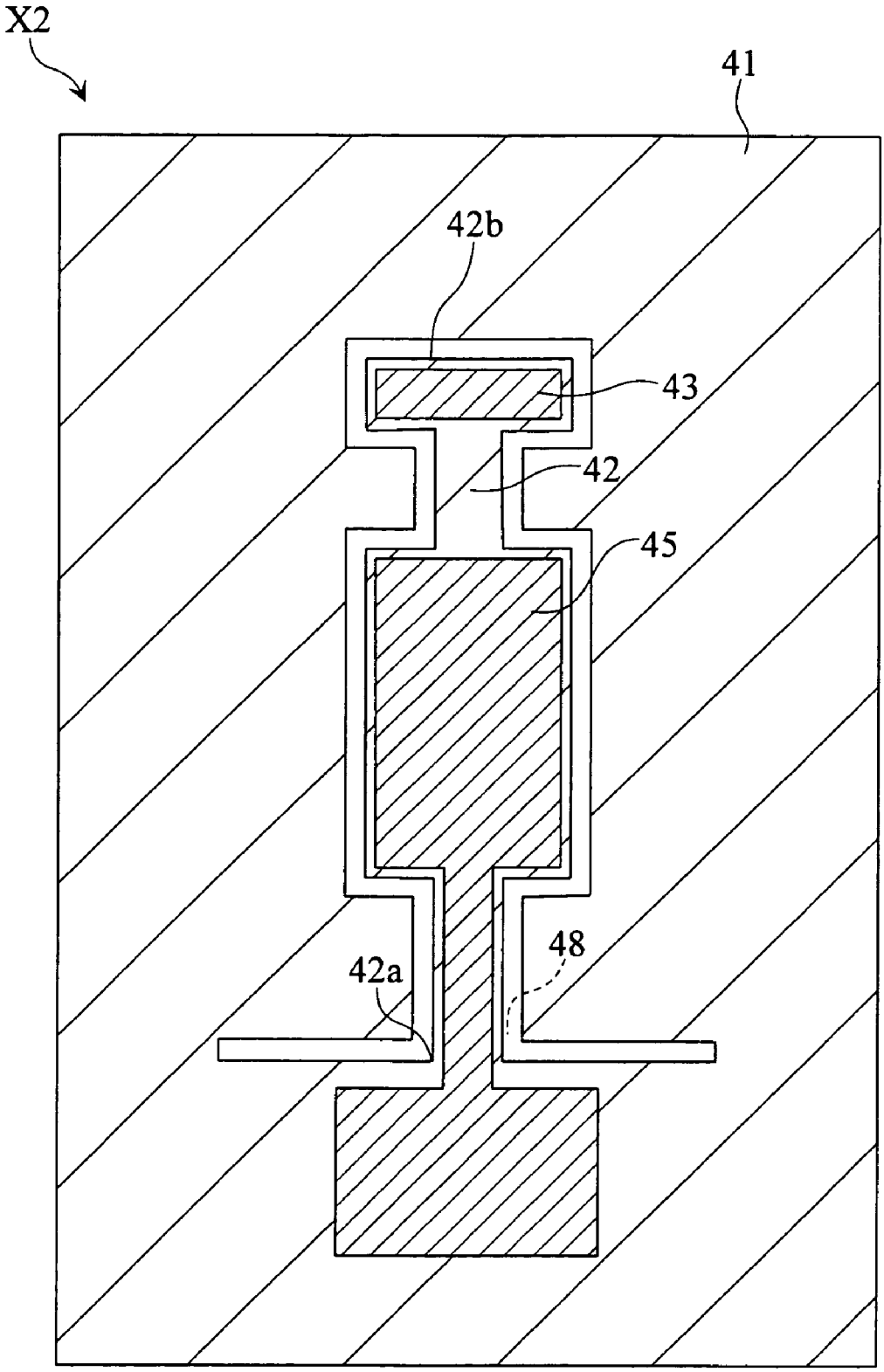
FIG. 15 is a partial plane view of the microswitching device shown in FIG. 14.
Figure 16:
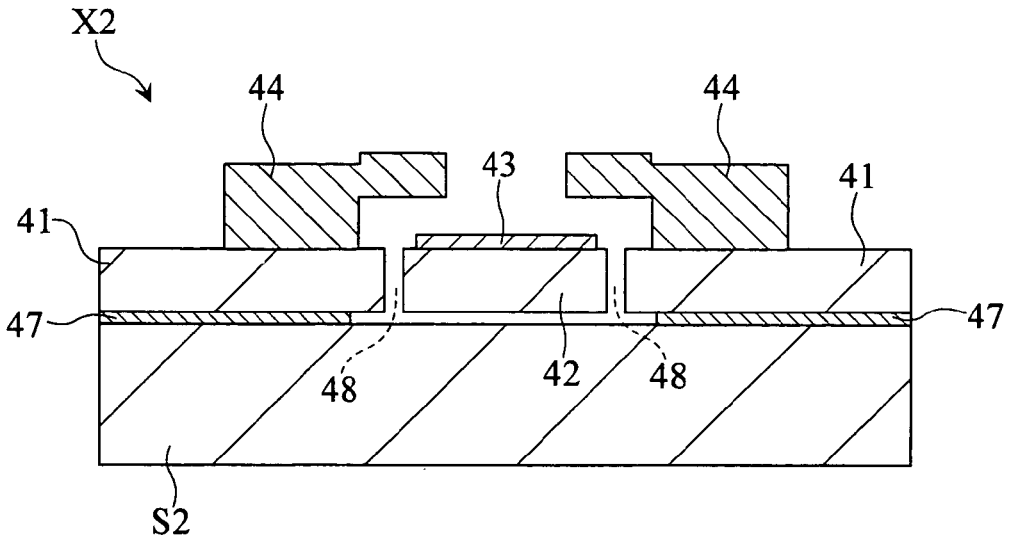
FIG. 16 is a cross-sectional view along line XVI-XVI in FIG. 14.
Figure 17:
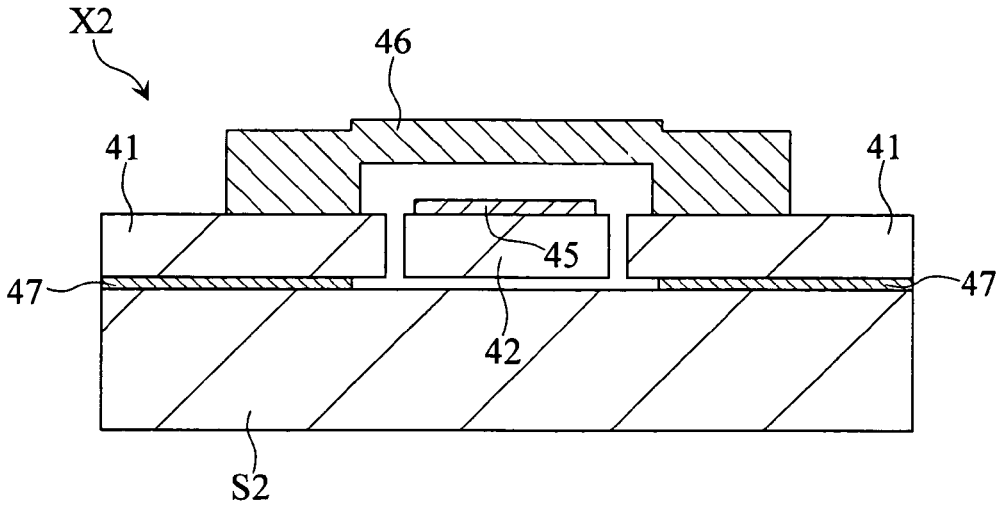
FIG. 17 is a cross-sectional view along line XVII-XVII in FIG. 14.
Figure 18:
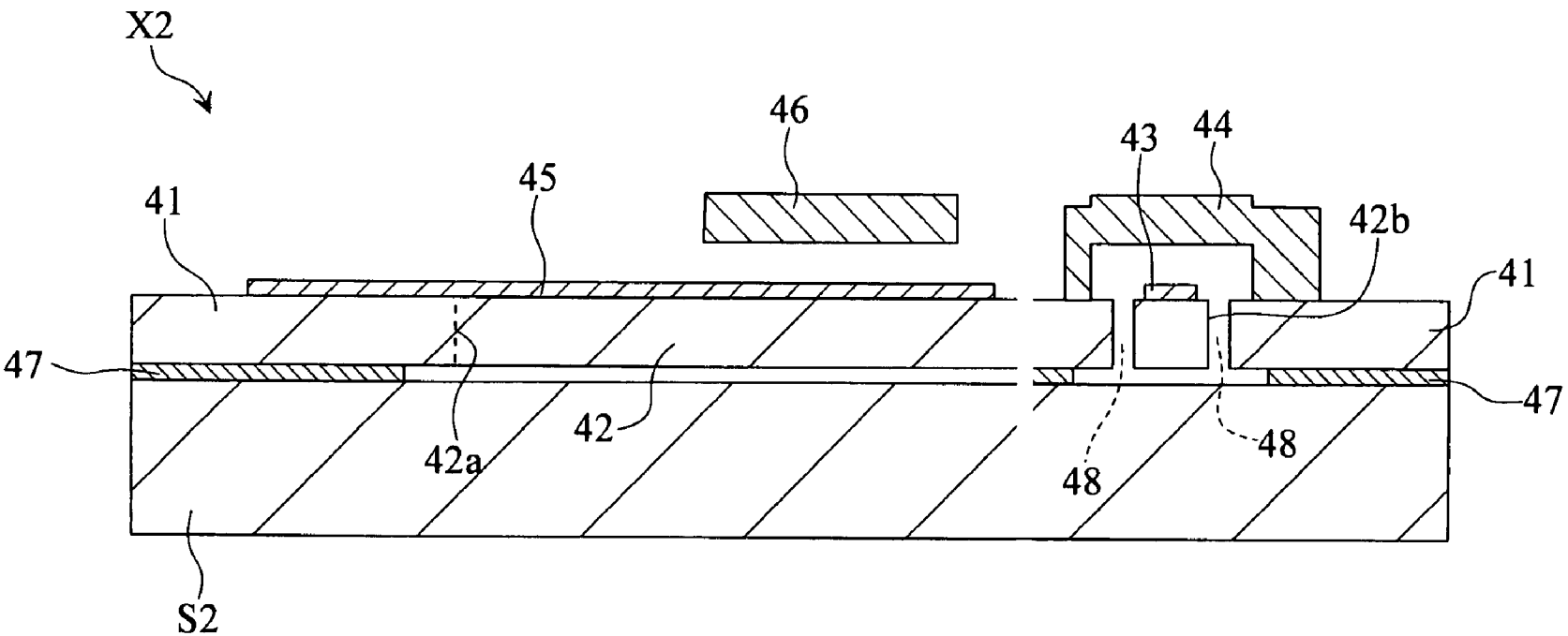
FIG. 18 is a cross-sectional view along line XVIII-XVIII in FIG. 14.
Figure 19:
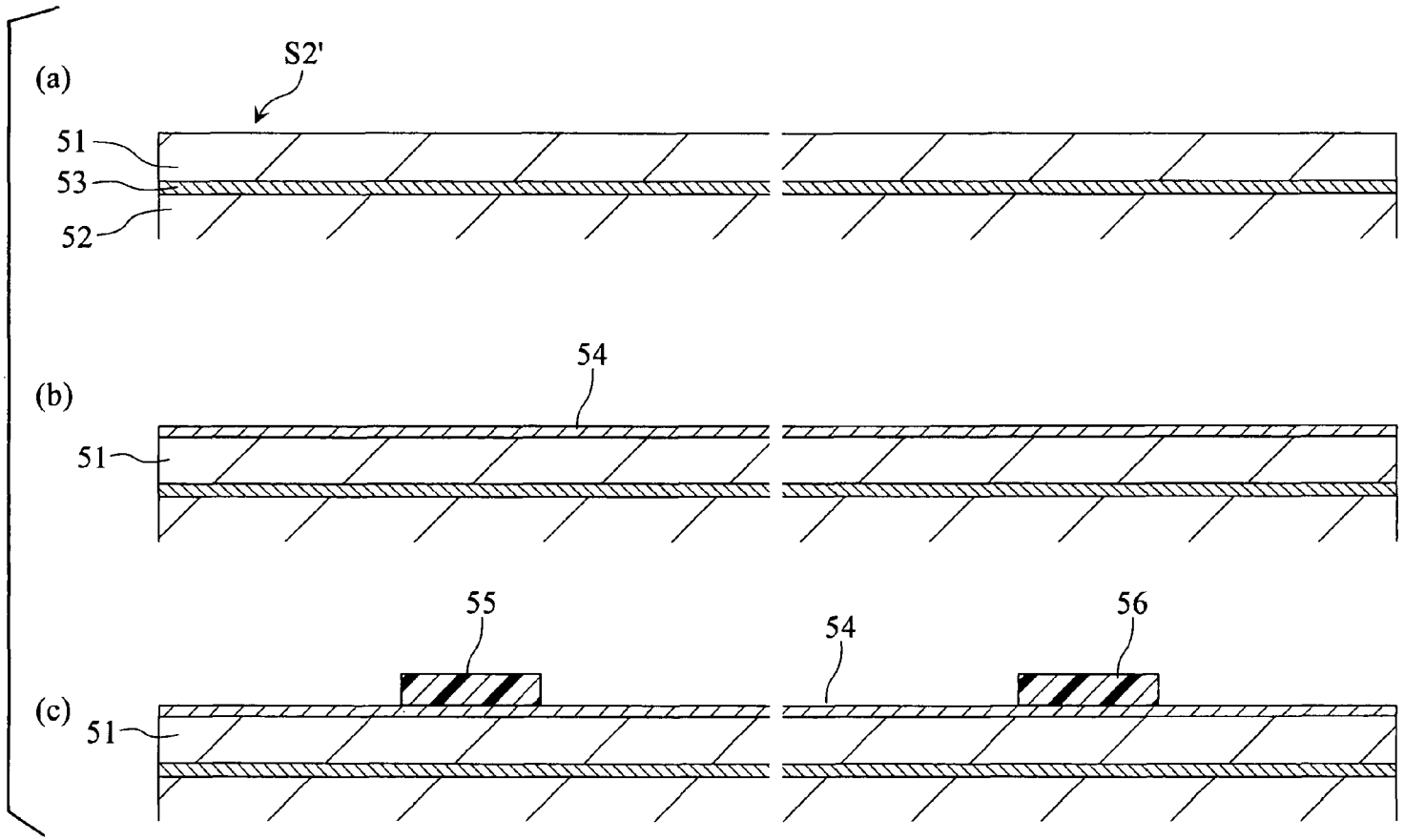
FIG.19 PRIOR ART
FIG. 19 shows steps in a method of manufacture of the microswitching device of the prior art shown in FIG. 14.
Figure 20:
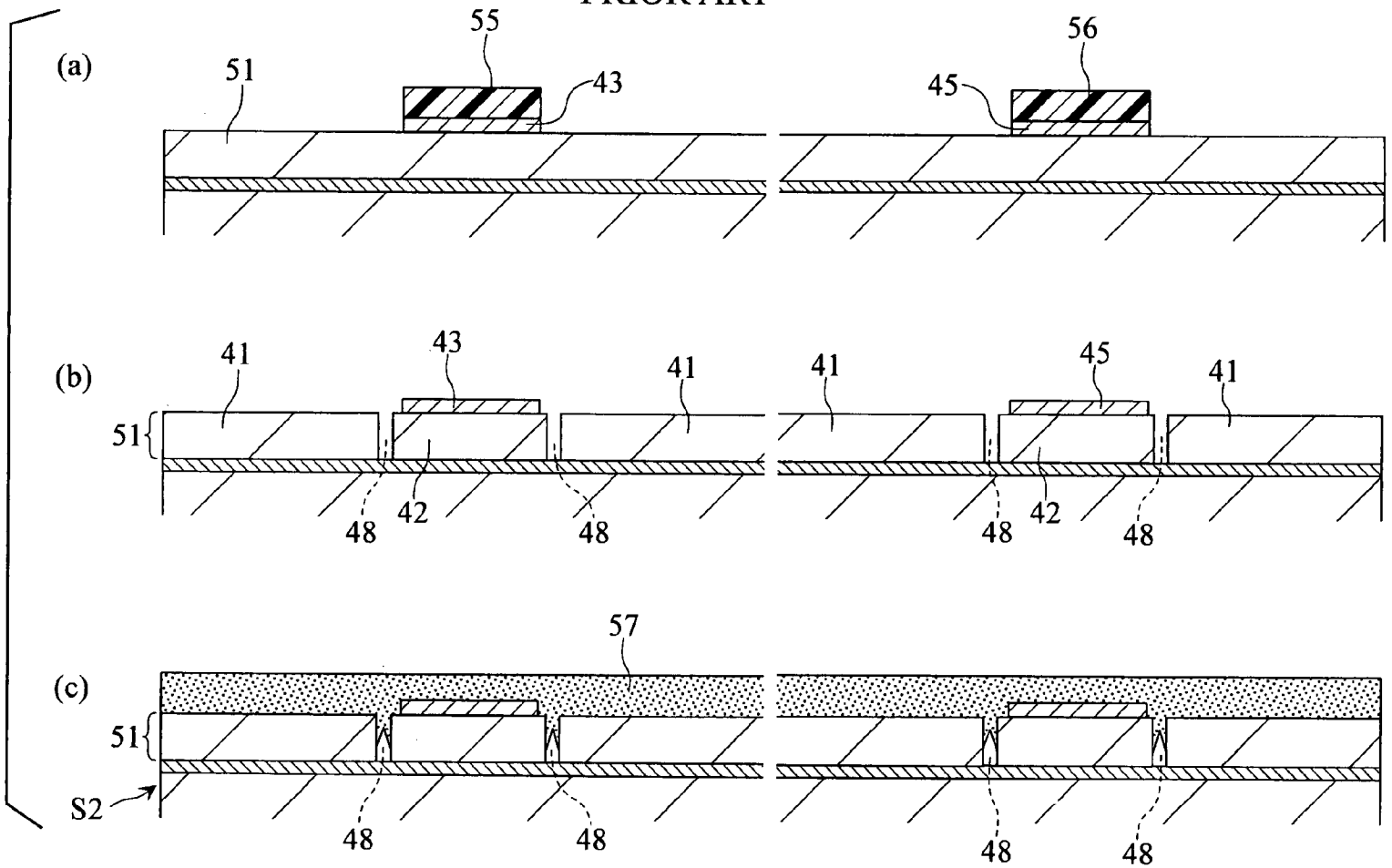
FIG.20 PRIOR ART
FIG. 20 shows steps following those of FIG. 19.
Figure 21:
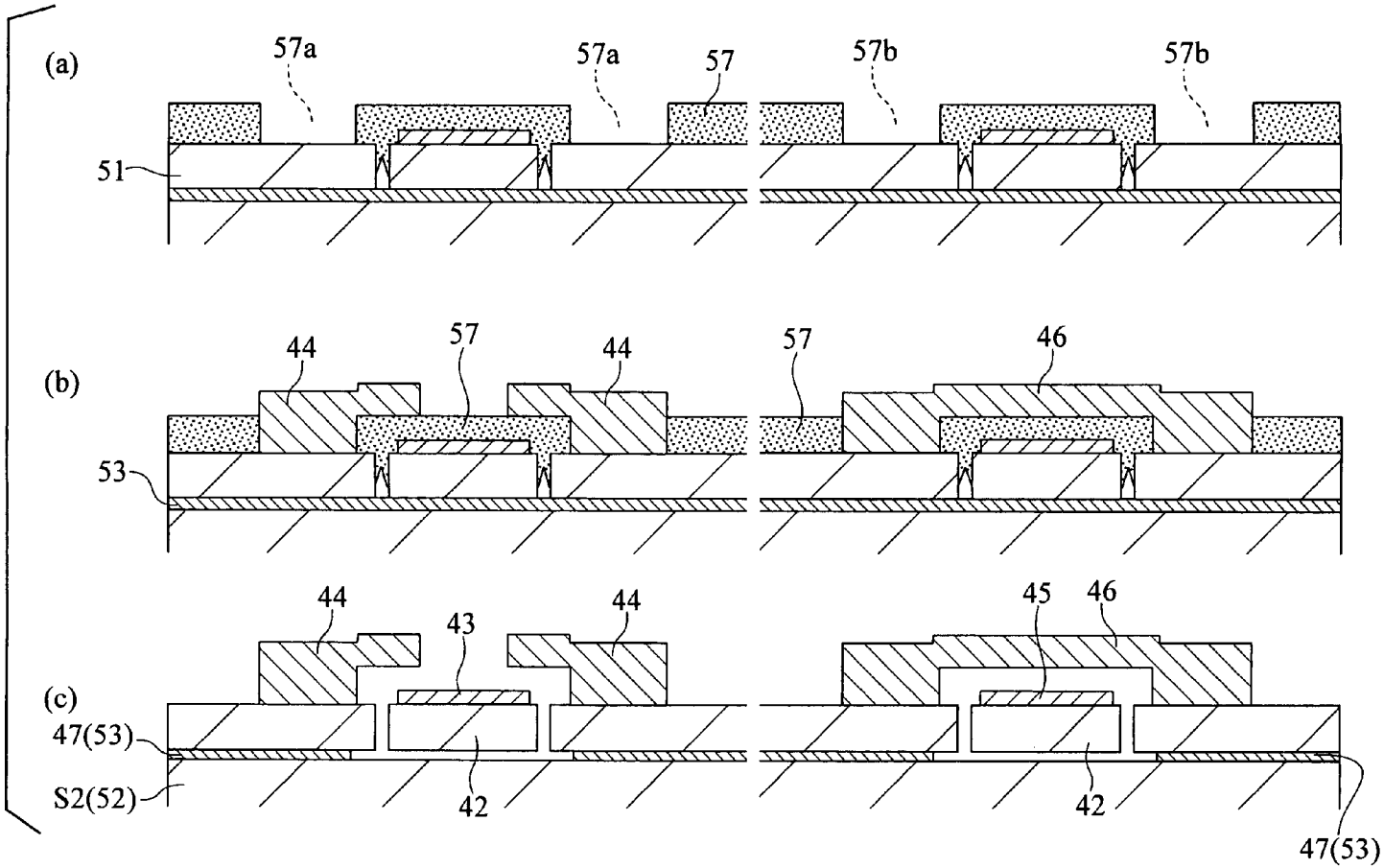
FIG.21 PRIOR ART
FIG. 21 shows steps following those of FIG. 20.

FIG. 11 and FIG. 12 show a second method of manufacture of the microswitching device X1, as changes in the cross-section equivalent to FIG. 3 and FIG. 4. In this method, first a material substrate S1' is prepared as shown in FIG. 11(*a*), and then a conductive film 24 is formed on the first layer 21 as shown in FIG. 11(*b*), similarly to the first manufacturing method.

Next, as shown in FIG. 11(*c*), photolithography is used to form a resist pattern 31 on the conductive film 24. The resist pattern 31 has a pattern shape corresponding to the contact electrode 13.

Next, as shown in FIG. 12(*a*), the conductive film 24 is processed. Specifically, the resist pattern 31 is used as a mask to perform etching on the conductive film 24 to partway in the thickness direction of the conductive film 24.

Next, after removing the resist pattern 31 which has been exposed to the etching treatment and has been degraded, the resist patterns 32 and 33 are formed by photolithography on the conductive film 24, as shown in FIG. 12(*b*). The resist pattern 32 has a pattern shape corresponding to the contact electrode 13. The resist pattern 33 has a pattern shape corresponding to the driving electrode 15. If the extent of degradation of the resist pattern 31 is small, in this process the resist pattern 33 can be formed without removing the resist pattern 31, and without forming the resist pattern 32.

Next, as shown in FIG. 12(*c*), the resist patterns 32 and 33 are used as masks to perform etching on the conductive film 24, to form the contact electrode 13 and driving electrode 15 on the first layer 21. In this process, the driving electrode 15, which is thinner than the contact electrode 13, is formed on the first layer 21.

Thereafter, processes similar to the processes described above referring to FIG. 8 through FIG. 10 in the first manufacturing method are performed, to manufacture the microswitching device X1 shown in FIG. 1 through FIG. 5. In the second manufacturing method also, similarly to the first manufacturing method, a microswitching device X1, comprising on the movable portion 12 a contact electrode 13 and a driving electrode 15 thinner than the contact electrode 13, can be appropriately manufactured.

Embodiment 1 (EM1)

A microswitching device X1 such as that described above was prepared, with a movable portion 12 using silicon as the constituent material, having a spring constant of 24 N/m, a length L1 of 900 μm, and a contact electrode 13 (movable contact electrode film) with thickness T2 of 0.75 μm, and having a driving electrode 15 (movable driving electrode film) with a stacked structure of Mo film on top of which was Au film, with thickness T3 of 0.35 μm and area 60,000 $\mu m^2$; the length L3 of the driving electrode 15 on the movable portion 12 was 800 μm, the distance between the contact electrodes 13 and 14 in the state in which the movable portion 12 was not deformed was 4.0 μm, and the distance between the driving electrodes 15 and 16 in the state in which the movable portion 12 was not deformed was 4.5 μm.

When there was no driving of the microswitching device of this embodiment (when no voltage was applied across the driving electrodes 15 and 16), the amount of displacement of the free end 12*b* of the movable portion 12 (that is, the amount of warping of the movable portion 12) was 3.3 μm, and the contact electrode 13 was not in contact with the contact electrodes 14, nor was the driving electrode 15 in contact with the driving electrode 16. The amount of displacement of the free end 12*b* was evaluated taking the position of the free end 12*b* in the state in which the movable portion 12 was not deformed to be the reference position (0 μm). Upon measuring the minimum driving voltage (the minimum potential difference to be generated across the driving electrodes 15 and 16 in order to achieve the closed state of the microswitching device) for the microswitching device of this embodiment, the minimum driving voltage was found to be 12 V. These results are presented in the table of FIG. 13.

Embodiment 2 (EM2)

A microswitching device was prepared with the same conditions as in Embodiment 1, other than a spring constant for the movable portion 12 of 40 N/m instead of 24 N/m, and a thickness T3 for the driving electrode 15 of 0.53 μm instead of 0.35 μm. When there was no driving of the microswitching device of this embodiment, the amount of displacement of the free end 12*b* of the movable portion 12 was 3.5 μm, the contact electrode 13 did not make contact with the contact electrodes 14, and the driving electrode 15 did not make contact with the driving electrode 16. The minimum driving voltage of the microswitching device of this embodiment was measured and found to be 16 V. These results are presented in the table of FIG. 13.

Comparison Example 1 (CE1)

A microswitching device was prepared with the same conditions as in Embodiment 1, other than having a spring constant for the movable portion 12 of 40 N/m instead of 24 N/m, and comprising a driving electrode (movable driving electrode film) different from that of the driving electrode 15 of Embodiment 1. The driving electrode of this Comparison Example had a thickness of 0.75 μm (and so, in this Comparison Example, the contact electrode 13 and this driving electrode on the movable portion 12 had the same thickness), provided at the same location on the movable portion 12 as the driving electrode 15 in Embodiment 1. When there was no driving of the microswitching device of this Comparison Example, the contact electrode 13 was in contact with the contact electrodes 14. Consequently, it was not possible to measure the minimum driving voltage of the microswitching device of this Comparison Example. These results are presented in the table of FIG. 13.

Comparison Example 2 (CE2)

A microswitching device was prepared with the same conditions as in Embodiment 1, other than having a spring constant for the movable portion 12 of 66 N/m instead of 24 N/m, and comprising a driving electrode (movable driving electrode film) different from that of the driving electrode 15 of Embodiment 1. The driving electrode of this Comparison Example had a thickness of 0.75 μm (and so, in this Comparison Example, the contact electrode 13 and this driving electrode on the movable portion 12 had the same thickness), provided at the same location on the movable portion 12 as the driving electrode 15 in Embodiment 1. When there was no driving of the microswitching device of this Comparison Example, the amount of displacement of the free end 12*b* of the movable portion 12 was 3.2 μm, the contact electrode 13 was not in contact with the contact electrodes 14, and the driving electrode 15 was not in contact with the driving electrode 16. The minimum driving voltage of the microswitching device of this Comparison Example was measured and found to be 25 V. These results are presented in the table of FIG. 13.

Evaluation

In the microswitching devices of Embodiments 1 and 2, the driving electrode 15 (movable driving electrode film) was thinner than the contact electrode 13 (movable contact electrode film), so that the driving voltage could be lowered. Specifically, in the microswitching device of Embodiment 1, in which the thickness of the driving electrode 15 was 0.35 μm, the spring constant of the movable portion 12 was set to 24 N/m, and the contact electrodes 13 and 14 could be closed using a low driving voltage of 12 V. In the microswitching device of Embodiment 2, in which the thickness of the driving electrode 15 was 0.53 μm, the spring constant of the movable portion 12 was set to 40 N/m, and the contact electrodes 13 and 14 could be closed using a low driving voltage of 16 V.

In the microswitching devices of Comparison Examples 1 and 2, the movable driving electrode film was comparatively thick, having the same thickness (0.75 μm) as the contact electrode 13 (movable contact electrode film), and so a low driving voltage could not be achieved. Specifically, in the microswitching device of Comparison Example 1, with the spring constant of the movable portion 12 set to 40 N/m, the contact electrodes 13 and 14 were in contact even when there was no driving. The microswitching device of Comparison Example 1 could not function as a microswitching device. In the case of the microswitching device of Comparison Example 2, the spring constant of the movable portion 12 of which was set to 66 N/m, a driving voltage of as much as 25 V was required, so that a low driving voltage could not be achieved.

The invention claimed is:

1. A microswitching device comprising:

a base;

a fixed portion joined to the base;

a movable portion extending along the base and having a fixed end fixed to the fixed portion, the movable portion including a first surface facing the base and a second surface opposite to the first surface;

a movable contact electrode film provided on the second surface of the movable portion;

a pair of fixed contact electrodes each joined to the fixed portion and each having a region opposing the movable contact electrode film;

a movable driving electrode film provided on the second surface of the movable portion, the movable driving electrode film on the second surface being thinner than the movable contact electrode film on the second surface; and a fixed driving electrode having a region opposing the movable driving electrode film, the fixed driving electrode being joined to the fixed portion;

wherein the movable contact electrode and the movable driving electrode are made of a same material, and wherein each of the movable contact electrode and the movable driving electrode is provided, as a whole, on the second surface of the movable portion, so as not to extend beyond the second surface toward the first surface of the movable portion.

2. The microswitching device according to claim 1, wherein the movable contact electrode film is positioned further from the fixed end of the movable portion than the movable driving electrode film.

3. The microswitching device according to claim 1 or 2, wherein the thickness of the movable driving electrode film is no greater than 0.53 μm.

4. The microswitching device according to claim 1 or 2, wherein the thickness of the movable contact electrode film is in a range from 0.5 to 2.0 μm.

5. The microswitching device according to claim 1 or 2, wherein the spring constant of the movable portion is no greater than 40 N/m.

6. A method of making a microswitching device which comprises: a base; a fixed portion joined to the base; a movable portion extending along the base and having a fixed end fixed to the fixed portion, the movable portion including a first surface facing the base and a second surface opposite to the first surface; a movable contact electrode film and movable driving electrode film provided on the second surface of the movable portion; a pair of fixed contact electrodes each joined to the fixed portion and each having a region opposing the movable contact electrode film; and a fixed driving electrode having a region opposing the movable driving electrode film and joined to the fixed portion; the method comprising:

preparing a material substrate having a stacked structure including a first layer, a second layer, and an intermediate layer between the first and the second layers;

forming a conductive film on the first layer;

forming a movable contact electrode film and a movable driving electrode film precursor on a same surface of the first layer by patterning the conductive film; and forming a movable driving electrode film by performing etching on the movable driving electrode film precursor, the movable driving electrode film being thinner than the movable contact electrode film;

wherein each of the movable driving electrode film and the movable contact electrode film is provided, as a whole, on said same surface of the first layer, so as not to extend beyond said same surface of the first layer toward the second layer.

7. A method of making a microswitching device which comprises: a base; a fixed portion joined to the base; a movable portion extending along the base and having a fixed end fixed to the fixed portion, the movable portion including a first surface facing the base and a second surface opposite to the first surface; a movable contact electrode film and movable driving electrode film provided on the second surface of the movable portion; a pair of fixed contact electrodes each joined to the fixed portion and each having a region opposing the movable contact electrode film; and a fixed driving electrode having a region opposing the movable driving electrode film and joined to the fixed portion; the method comprising:

preparing a material substrate having a stacked structure including a first layer, a second layer, and an intermediate layer between the first and the second layers;

forming a conductive film on the first layer;

forming on the conductive film a first mask pattern having a pattern shape corresponding to the movable contact electrode film;

performing etching on the conductive film with use of the first mask pattern until partway in the thickness direction of the conductive film;

forming on the conductive film a second mask pattern having a pattern shape corresponding to the movable driving electrode film; and performing etching on the conductive film with use of the first and the second mask patterns to form a movable contact electrode film and a movable driving electrode film on a same surface of the first layer, the movable driving electrode film being thinner than the movable contact electrode film;

wherein each of the movable driving electrode film and the movable contact electrode film is provided, as a whole, on said same surface of the first layer, so as not to extend beyond said same surface of the first layer toward the second layer.

8. The method according to claim 6 or 7, further comprising:

performing etching on the first layer to form a movable portion and a fixed portion in the first layer;

forming a sacrificial layer covering the first-layer side and having at least two opening portions to expose fixed contact electrode joining areas in the fixed portion and at least one opening portion to expose a fixed driving electrode joining area in the fixed portion;

forming fixed contact electrodes and a fixed driving electrode, the fixed contact electrodes each having a region opposing the movable contact electrode film with the sacrificial film intervening and each being joined to the fixed portion at the fixed contact electrode joining area, the fixed driving electrode having a region opposing the movable driving electrode film with the sacrificial film intervening and being joined to the fixed portion at the fixed driving electrode joining area; and removing the sacrificial layer and the regions of the intermediate layer between the second layer and the movable portion.

* * * * *